US006763961B2

(12) United States Patent
Gardner et al.

(10) Patent No.: US 6,763,961 B2
(45) **Date of Patent: *Jul. 20, 2004**

(54) APPARATUS FOR OPENING A BOTTLE SEALED WITH A CORK STOPPER

(75) Inventors: William A. Gardner, Yountville, CA (US); Gil G. Gilley, Napa, CA (US)

(73) Assignee: Gardner Technologies, Inc., Napa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/306,633

(22) Filed: Nov. 27, 2002

(65) Prior Publication Data

US 2003/0146184 A1 Aug. 7, 2003

Related U.S. Application Data

(63) Continuation of application No. 09/760,375, filed on Jan. 12, 2001, now Pat. No. 6,510,957, which is a continuation-in-part of application No. 09/273,838, filed on Mar. 22, 1999, now Pat. No. 6,179,140, which is a continuation-in-part of application No. 08/746,799, filed on Nov. 18, 1996, now Pat. No. 5,885,798.

(51) Int. Cl.[7] ..... B65D 39/00

(52) U.S. Cl. ..... 215/299; 215/296; 215/364; 81/3.45

(58) Field of Search ..... 215/296, 297, 215/299, 364, 211, 215; 81/3.45, 3.48, 3.49

(56) References Cited

U.S. PATENT DOCUMENTS

| | | | |
|---|---|---|---|
| 33,364 | A | 10/1861 | Lindemeyr |
| 604,062 | A | 5/1898 | Meyer |
| 624,384 | A | 5/1899 | Schroeder |
| 773,857 | A | 11/1904 | Effenberger |

(List continued on next page.)

FOREIGN PATENT DOCUMENTS

| | | |
|---|---|---|
| DE | 197203 | 9/1907 |
| DE | 297516 | 4/1917 |
| DE | 2541318 | 3/1977 |
| DE | 2444081 | 8/1980 |
| DE | 3123902 | 6/1982 |
| DE | 19609487 | 12/1996 |
| FR | 2280 | 3/1904 |
| FR | 620803 | 4/1927 |
| FR | 1237031 | 6/1960 |
| FR | 2240871 | 3/1975 |
| FR | 2766163 | 1/1999 |
| GB | 128179 | 7/1919 |
| WO | WO 97/28056 | 1/1997 |
| WO | WO 00/32489 | 11/1999 |

OTHER PUBLICATIONS

Copy of International Search Report from International Application Serial No. PCT/US01/51643.

Copy of International Search Report from International Application Serial No. PCT/US99/06302.

*Primary Examiner*—Stephen K. Cronin
(74) *Attorney, Agent, or Firm*—John P. O'Banion

(57) ABSTRACT

An apparatus for removing a cork from a bottle in which an anchor is embedded in the cork and a cork-pulling sleeve is provided for engaging the anchor for removal of the cork. The cork-pulling sleeve includes inner threads that mate with external threads on the neck of the bottle, and rotation of the cork-pulling sleeve in relation to the bottle extracts the cork.

36 Claims, 19 Drawing Sheets

U.S. PATENT DOCUMENTS 778,593 A 12/1904 Maconnell
884,322 A 4/1908 Deusch
1,131,985 A 3/1915 Bellois
1,204,712 A 11/1916 Spelling
1,341,680 A 6/1920 Spelling
1,416,616 A 5/1922 Crane
1,464,646 A 8/1923 Cross
1,818,626 A 8/1931 Johnston
1,942,810 A 1/1934 Gibbs
2,193,381 A 3/1940 Prough
2,742,170 A 4/1956 Bramming
2,801,017 A 7/1957 Cortat
2,987,175 A 6/1961 Bottum
3,307,727 A 3/1967 Garay
3,339,772 A 9/1967 Miller
3,499,568 A 3/1970 Riera
3,589,983 A 6/1971 Holderith et al.
3,604,585 A 9/1971 Towns
3,612,325 A 10/1971 Williams
3,695,475 A 10/1972 Ruekberg
3,736,899 A 6/1973 Manske
3,831,796 A 8/1974 Classen
3,847,295 A 11/1974 Taylor
3,940,005 A 2/1976 Granat
3,944,104 A 3/1976 Watson et al.
3,946,891 A 3/1976 Picoy et al.
4,076,142 A 2/1978 Naz
4,084,717 A 4/1978 King
4,373,641 A 2/1983 Banich, Sr. et al.
4,392,579 A 7/1983 Unlig et al.
4,436,401 A 3/1984 Taylor
4,446,673 A 5/1984 Desthieux
4,446,980 A 5/1984 Oliver et al.
4,493,427 A 1/1985 Wolkonsky
4,574,662 A 3/1986 Jones
4,592,477 A 6/1986 Leonhardt et al.
4,605,135 A 8/1986 Ryder
4,664,276 A 5/1987 Taragna et al.
4,733,787 A 3/1988 Knopf et al.
4,767,016 A 8/1988 Cook, Jr. et al.
4,771,923 A 9/1988 Zinnbauer
4,809,858 A 3/1989 Ochs
4,812,408 A 3/1989 Hammann et al.
4,830,970 A 5/1989 Madaus et al.
4,834,251 A 5/1989 Yu
4,844,273 A 7/1989 Hawkins
4,889,251 A 12/1989 Hojinoski
4,948,000 A 8/1990 Grabenkort
5,012,942 A 5/1991 Druesne et al.
5,056,676 A 10/1991 Allen et al.
5,071,017 A 12/1991 Stull
5,080,245 A 1/1992 Conard
5,096,083 A 3/1992 Shaw et al.
D331,367 S 12/1992 Armstrong
5,209,997 A 5/1993 Phillips
5,269,429 A 12/1993 Schumacher
5,431,305 A 7/1995 Zaminski
5,455,180 A 10/1995 Reid
5,480,915 A 1/1996 Burns
5,495,958 A 3/1996 Konrad et al.
D383,067 S 9/1997 Gowwer et al.
5,662,233 A 9/1997 Reid
5,803,281 A 9/1998 Towns
5,884,789 A 3/1999 Gardner
5,944,208 A 8/1999 Gale
5,975,322 A 11/1999 Reid
6,029,836 A 2/2000 Ligeras
6,153,275 A 11/2000 Yaniger
6,179,140 B1 1/2001 Gardner
D450,589 S 11/2001 Haake et al.
D451,400 S 12/2001 LaBombarbe et al.
6,325,247 B1 12/2001 Iggulden
6,355,320 B1 3/2002 Allman et al.
D457,067 S 5/2002 Martynov et al.
6,510,957 B2 1/2003 Gilley et al.

APPARATUS FOR OPENING A BOTTLE SEALED WITH A CORK STOPPER

CROSS-REFERENCE TO RELATED APPLICATIONS

This application is a continuation of U.S. application Ser. No. 09/760,375 filed on Jan. 12, 2001, now U.S. Pat. No. 6,510,957, which is a continuation-in-part of application Ser. No. 09/273,838 filed on Mar. 22, 1999, now U.S. Pat. No. 6,179,140, which is a continuation-in-part of application Ser. No. 08/746,799 filed on Nov. 18, 1996, now U.S. Pat. No. 5,885,798.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to devices and methods for removing corks from wine bottles, and more particularly to a cork removal apparatus in which an anchor is integrated with the cork, in which a cork-pulling sleeve with internal threads engages external threads on the neck of the bottle, and in which the cork is extracted by rotating the cork-pulling sleeve in relation to the bottle.

2. Description of the Background Art

Wine and a few other beverages are typically packaged in glass bottles that are sealed with a cork stopper. Although "easy-open" containers such as snap-top cans and screw-cap bottles are well known, there are several reasons why easy-open technologies have not been widely adopted in the wine industry. Two particularly salient reasons are that (i) the aesthetic appeal of corked bottles is important to wine consumers, and (ii) no completely adequate means for quick and easy removal of corks, without the use of awkward, cumbersome, or clumsy auxiliary cork removing devices (such as cork screws, cork pullers, pressure pumps, etc.), has yet been invented that is also compatible with bottling lines.

A completely adequate means for quick and easy removal of corks from wine bottles must meet four basic requirements. The first is that the cork must provide an adequate seal against the inside walls of the neck of the bottle. The second is that a permanently installed pulling device must not protrude through the bottom or sides of the cork and it must not split or tear the cork because of the likelihood of resultant wine leakage and/or wine contamination. The third is that the cork and cork-puller installation into the wine bottle must not unduly complicate the present bottle-corking technology used throughout the industry. The fourth is that the cork must be easily extractable by the consumer without the use of cumbersome, awkward, or clumsy auxiliary devices. These requirements, however, tend to work against one another.

Therefore, a need exists for a self-contained cork and cork-removal apparatus that allows for "easy extraction" of the cork while still providing an adequate cork/glass seal that meets the four basic requirements outlined above. As used herein, "easy extraction" means that no cumbersome, awkward, or clumsy auxiliary equipment, such as cork screws that must be screwed into the cork by the consumer, blade style cork removers that require inserting a pair of blades between the cork and bottle, or air-pump cork removers that require a needle to be forced through the cork and air pumped into the bottle to increase pressure, and so on, is required of the consumer, and that adequate pulling forces are as easily applied as with conventional cork screws. The present invention satisfies these needs, as well as others, and overcomes the deficiencies of previously developed cork removal devices.

SUMMARY OF THE INVENTION

The foregoing needs are addressed by the present invention which generally comprises a specially designed anchor which is configured for insertion into a traditional cork stopper used in the wine industry, and an associated cork-pulling sleeve that replaces the traditional metal foil capsule used in the wine industry. The anchor and cork-pulling sleeve are configured such that rotation of the cork-pulling sleeve in relation to the bottle exerts an axial force on the anchor that extracts the cork stopper.

By way of example, and not of limitation, the anchor has a shaft that extends into the cork and an annular head that rests above or on top of the cork. The cork pulling sleeve has internal threads which mate with external threads on the outer surface of the neck of the bottle. In addition, the cork pulling sleeve has an annular rib or lip that engages the head of the anchor. Rotating the capsule in relation to the bottle causes axial pressure to be exerted on the head of the anchor resulting in extraction of the cork. This configuration enables the consumer to apply pulling forces just as large as those currently being used with prior art auxiliary cork screws, and further allows the wine producer to use conventional cork coatings that provide a good wine seal. In addition, the present invention will have little or no impact on the high-speed mechanized corking equipment widely used in the industry, and does not introduce means by which the wine can be contaminated.

An object of the invention is to provide for the easy and convenient removal of a cork from a bottle.

Another object of the invention is to provide a cork removal apparatus that can be easily packaged with a bottle.

Another object of the invention is to avoid the requirement that the consumer perform the operation of anchoring a pulling device to the cork.

Another object of the invention is to avoid the requirement that the consumer force a device through, into, or along the sides of the cork.

Another object of the invention is that the consumer only be required to perform a simple unscrewing operation in order to uncork the bottle.

Another object of the invention is that the consumer not be required, after uncorking a bottle, to unscrew a corkscrew or similar means from the cork.

Another object of the invention is to provide a cork removal apparatus that can be manufactured at a sufficiently low cost for use as a disposable cork removal device.

Another object of the invention is to provide a cork removal apparatus that can be employed with corks of various styles, compositions, and manufacture including natural corks, synthetic corks, agglomerated natural corks, and others.

Another object of the invention is to eliminate mishaps whereby the "cork-screw" mechanism of rapid cork removal devices pulls back out and of the cork while leaving the cork still in the bottle.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
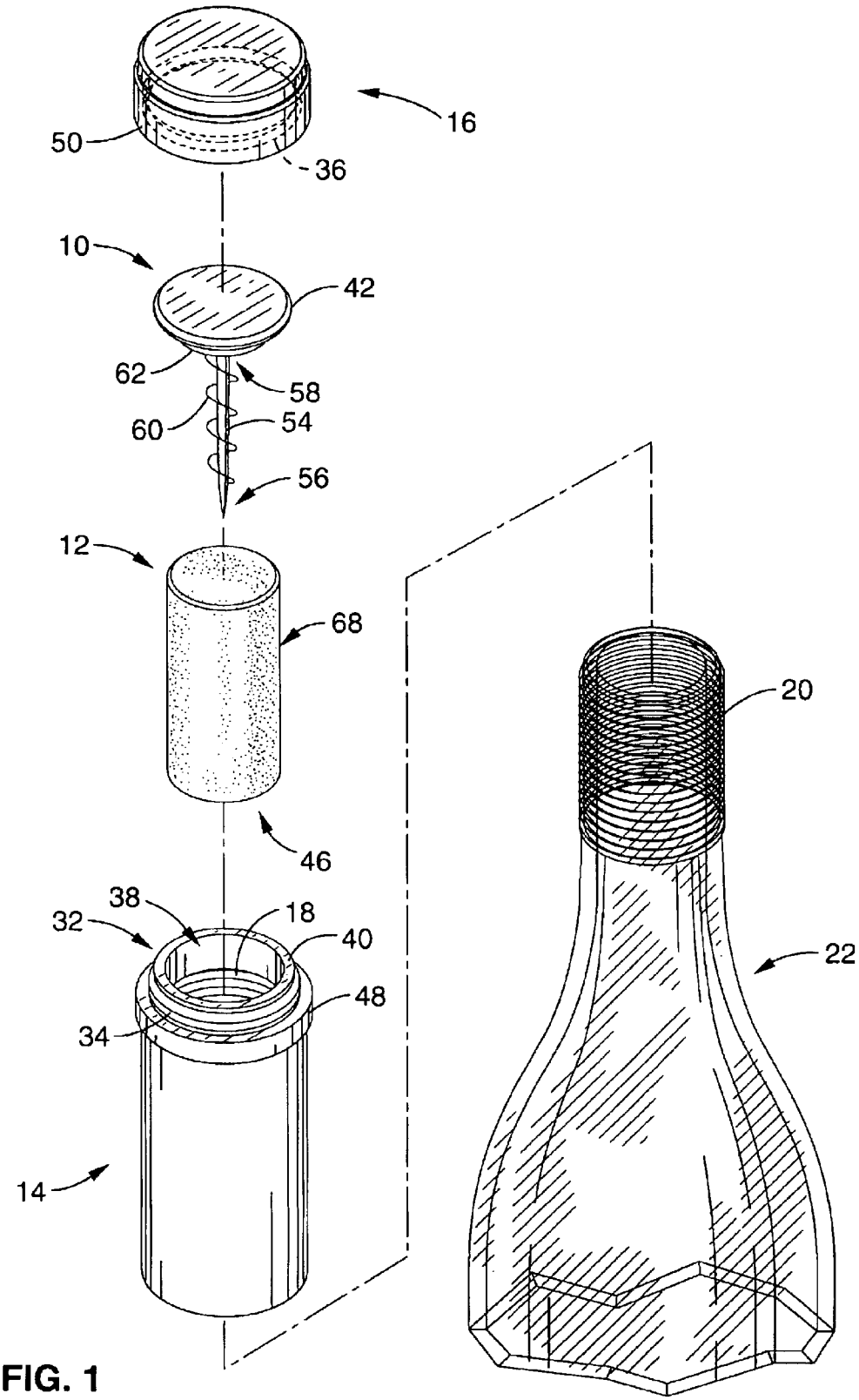
FIG. 1 is an exploded view of a cork removal apparatus according to the present invention shown in context with a conventional cork and a bottle modified to include outer threads on the neck of the bottle.

Referring more specifically to the drawings, for illustrative purposes the present invention is embodied in the apparatus generally shown in FIG. 1 through FIG. 25, where like reference numerals denote like parts. It will be appreciated that the apparatus may vary as to configuration and as to details of the parts without departing from the basic concepts as disclosed herein.

Referring first to FIG. 1 through FIG. 4, the preferred embodiment of a cork removal apparatus in accordance with the present invention comprises an anchor 10 which is configured for insertion into a conventional cork stopper 12 used in the wine industry, and an associated cork-pulling sleeve 14 that replaces the traditional metal foil capsule that is used in the wine industry. An optional reseal cap 16 is also provided.

Figure 2:
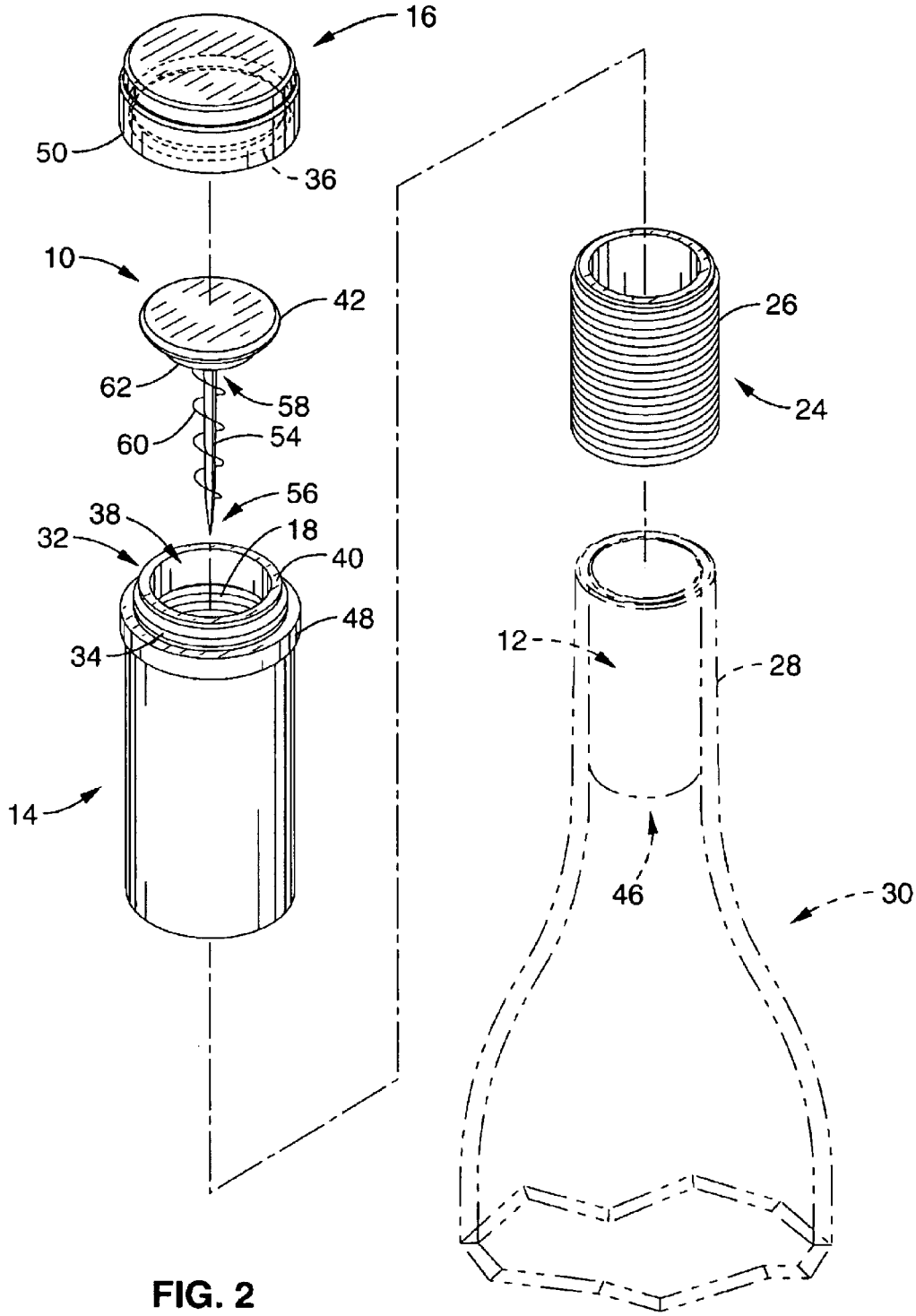
FIG. 2 is a exploded view of the cork removal apparatus shown in FIG. 1 where a sleeve is placed over the neck of the bottle to form outer threads on the bottle.

Cork-pulling sleeve 14, which is a hollow sleeve as shown, has inner threads 18 which are configured to engage complementary outer threads 20 on the neck of a wine bottle 22. In this regard, it will be appreciated that conventional wine bottles are not threaded and, therefore, outer threads 20 are preferably added during bottle manufacture as an integral part of the bottle. Alternatively, as shown in FIG. 2, an inner sleeve 24 having outer threads 26 could be placed over the neck 28 of a threadless bottle 30 provided that it is securely attached with an adhesive material having a sufficient bonding strength to prevent the sleeve from sliding or rotating.

Cork-pulling sleeve 14 also preferably includes a nipple 32 having outer threads 34 configured for engaging inner threads 36 of reseal cap 16. Note from FIG. 3 that outer threads 34 in nipple 32 match outer threads 20 on the neck of bottle 22 in both diameter and configuration. This is so that reseal cap 16 can screw onto either nipple 32 or the neck of bottle 22. There is also an opening 38 through the center of nipple 32 with an inner diameter sufficient large for cork stopper 12 to pass through.

Figure 3:
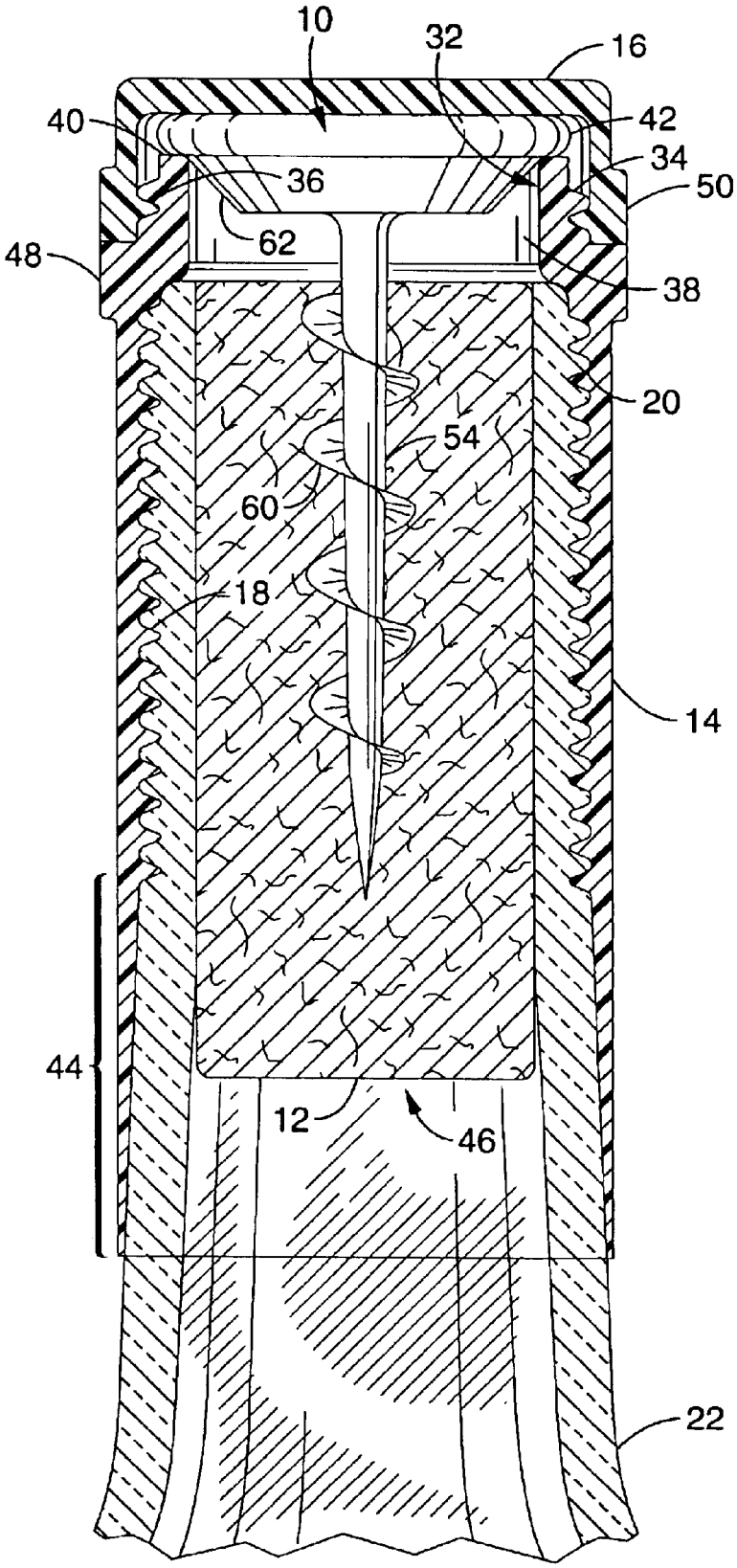
FIG. 3 is a side cross-sectional view of the cork removal apparatus shown in FIG. 1 with the anchor inserted in the cork, the cork inserted in the bottle, the cork-pulling sleeve screwed onto the bottle, and the reseal cap screwed onto the on the cork-pulling sleeve.
Figure 4:
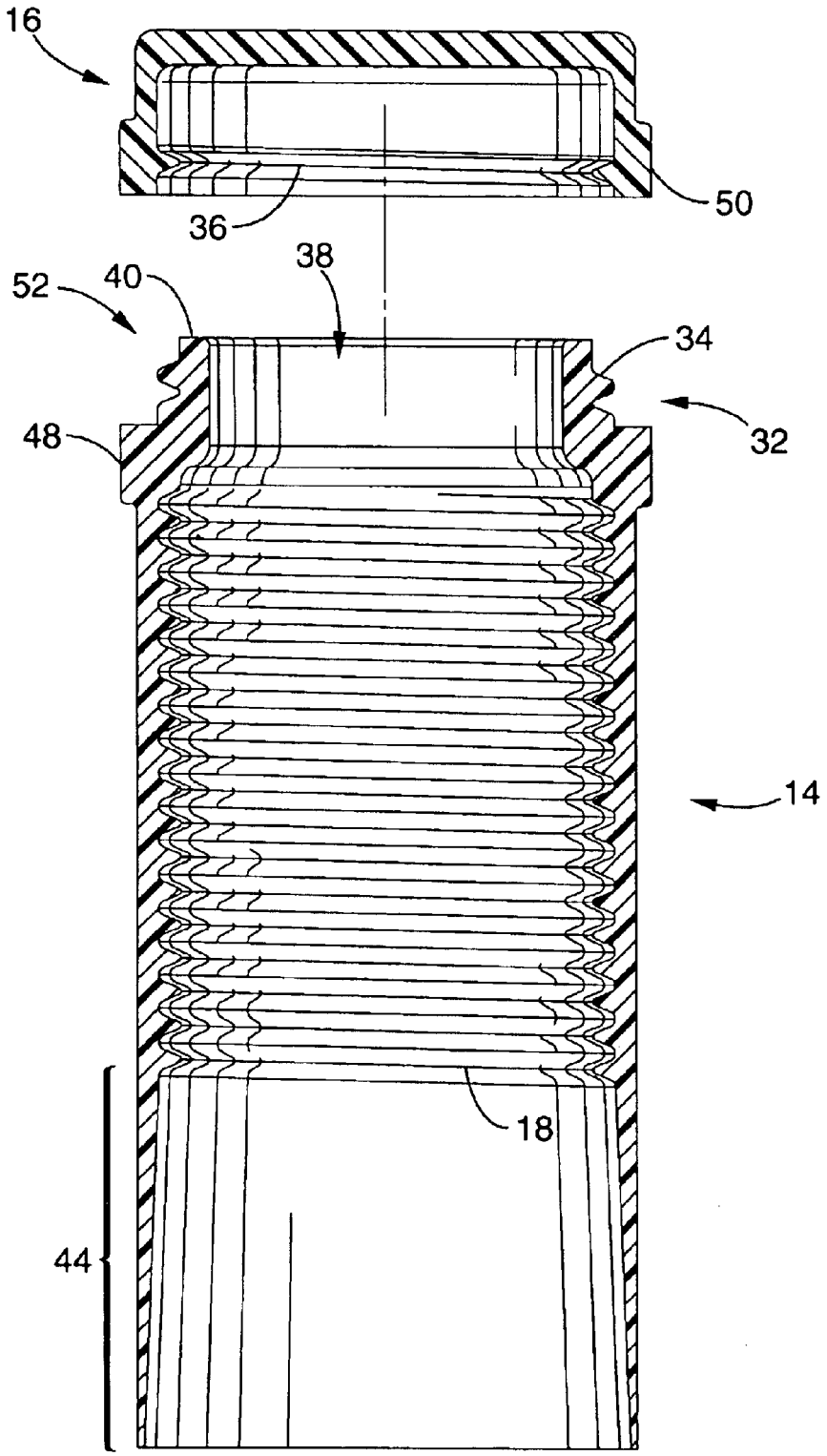
FIG. 4 is an exploded side cross-sectional view of the cork-pulling sleeve and reseal cap portions of the cork removal apparatus shown in FIG. 1.

As can be seen in FIG. 3, the lip 40 of nipple 32 fits beneath and engages the underside of a disk-shaped head 42 on anchor 10 to provide extraction force. Rotating cork-pulling sleeve 14 in relation to bottle 22 causes pressure to be exerted on head 42 of anchor 10 by lip 40 thereby extracting cork 12.

Note that cork-pulling sleeve 14 preferably includes several features that are both aesthetic and functional. For example, cork-pulling sleeve 14 has a tapered skirt portion 44 that follows the contour of the bottle. This feature provides a more finished look when installed on the bottle, and essentially produces a visual appearance similar to that of a traditional foil capsule used in the industry. As can be seen in FIG. 2, tapered skirt portion 44 gives the outward appearance of cork-pulling sleeve 14 being "paper thin" like conventional foil capsules. In addition, skirt portion 44 hides the lower, often stained, wet end 46 of the stopper. It also hides the transition of the neck of the bottle to the upper threaded area that is somewhat smaller than the part of the bottle neck the consumer sees on the store shelf just below cork-pulling sleeve 14. Note also that, once cork-pulling sleeve 14 is rotated and cork 12 has been moved, the taper in the bottle's neck at the bottom of cork-pulling sleeve 14 becomes exposed. At the same time, the thin skirt portion 44 of cork-pulling sleeve 14 no longer fits tight around the neck of bottle 22. This is evidence that the package has at least been opened partially. This feature in conjunction with the unique relationship of the anchor head to the reseal cap noted below provides evidence of tampering.

Another feature that is both functional and aesthetic is the inclusion of a collar 48 at the base of nipple 32. Reseal cap 16 includes a corresponding collar 50 so that the end of cork-pulling sleeve 14 transitions into a form that resembles the uppermost end of a conventional wine bottle when reseal cap 16 is attached to cork-pulling sleeve 14. These collars also provide corresponding stops which permit reseal cap 16 to be screwed onto nipple 32 without a gap therebetween so as to provide a smooth, finished look.

It will be appreciated that cork-pulling sleeve 14 plays a critical role in the invention. First, it must withstand the force imparted to it by the consumer gripping and twisting it in an effort to open bottle 22. Second, it also must transfer the force created between itself and the bottle threads 20 to head 42 of anchor 10 sufficient to remove cork 12. Therefore, opening 38 under anchor 10 must also be large enough to allow cork 12 to be easily removed out the top. This is somewhat difficult, as the upper portion of cork-pulling sleeve 14 must also transition to a narrower profile, the outer diameter of which fairly closely matches the upper end of the bottle. The reason for the narrowing of the profile is to provide a means of affixing the reseal cap to the assembly. The other factor further constricting the usable range of the diameter of opening 38 is the fact that cork 12 will expand as it is pulled from bottle 22. In other words, upper end 52 of cork-pulling sleeve 14 needs to have features and diameters closely approximating that of the exterior of bottle 22 on which it is used. At the same time, the inside diameter must be larger than the inside diameter of bottle 22 so as to allow easy passage of the cork stopper through the opening once released from the confine of the bottle.

As indicated above, anchor 10 is configured for attachment to a cork stopper that is used in the industry to seal wine bottles. As used herein, the term "cork" includes, but is not limited to, natural or synthetic corks, including plastic corks, agglomerated natural corks, foam corks and the like. Anchor 10 includes an elongated tapered shank 54 having first and second ends 56, 58, respectively, and spiral threads 60 around the circumference of shank 54 extending between first and second ends 56, 58. Shank 54 may or may not be tapered toward distal end 56, but tapering is preferred for ease of installation.

In the preferred embodiment, anchor 10 includes a flat disk-shaped head 42 and a conically tapered neck 62. Tapered neck 62 addresses the need for alignment between head 42 of anchor 10 and lip 40 on nipple 32 that provides a mating surface. The design constraints between opening 38, which must be large enough for cork 12 to be inserted and removed, and reseal cap 16 to go over the end of nipple 32, leaves only a narrow ring on which anchor head 42 can rest. Therefore, alignment during installation of anchor 10 is important. Inclusion of the conically tapered neck 62 is preferred because it aids with the centering of anchor 10 in cork-pulling sleeve 14 during anchor installation. While the truncated cone shape shown is preferred, neck 62 may also take on other geometric shapes that will achieve the same objective of centering the anchor. It will also be appreciated that anchor head 42 take can on other geometric shapes as well.

Figure 5:
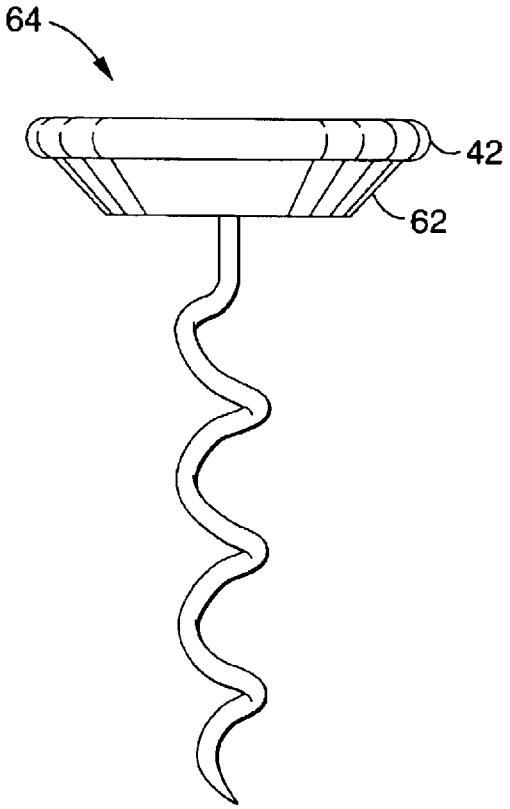
FIG. 5 is a side view of an anchor according to the present invention with a helical shank.
Figure 6:
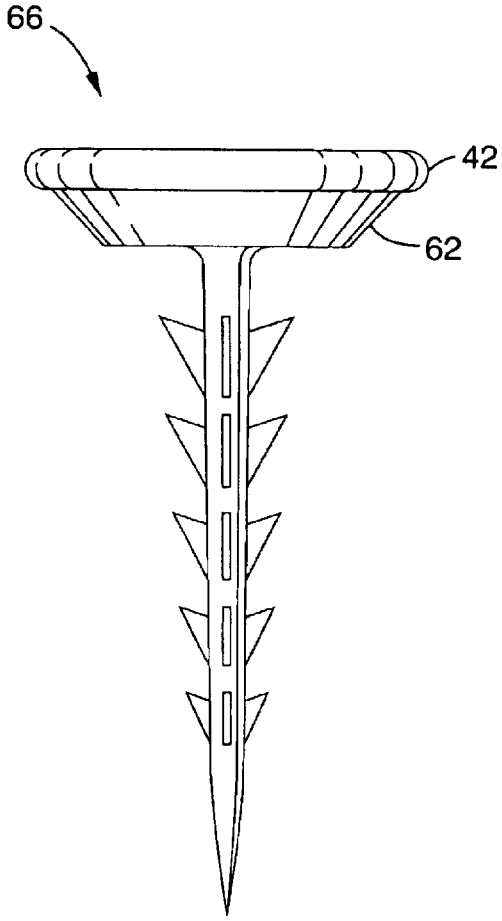
FIG. 6 is a side view of an anchor according to the invention with a barbed shank.

While the preferred configuration of anchor 10 has a shank 54 with threads 60, other anchor configurations can be used as well. For example, an open helix configuration 64 such as shown in FIG. 5 or a barbed configuration 66 as shown in FIG. 6 could be used. Other securement means on the anchor shaft can be used as well, such as protrusions, fingers, or the like. Regardless of the anchor configuration, however, because the anchor will remain in the cork for extended periods of time during storage, the integrity of cork must not be compromised when an anchor is inserted.

Consequently, bottom 46 and outside circumference 68 of cork 12 must not be broken through. Also, little or no tearing or splitting should occur in the interior of cork 12. Thus, some conventional screw designs may not suffice for anchor 10.

As indicated above, in the preferred embodiment of the invention reseal cap 16 includes inner threads 36 which mate with both outer threads 34 on nipple portion 32 of cork-pulling sleeve 14 and outer threads 20 on bottle 22. However, other reseal cap configurations can also be used, such as reseal caps that snap onto the cork-pulling sleeve and screw onto the bottle, that screw onto the cork-pulling sleeve and snap onto the bottle, that screw onto both the cork-pulling sleeve and the bottle, and that snap onto both the cork-pulling sleeve and the bottle.

Assembly is carried out by first installing cork-pulling sleeve 14 on bottle 22. This is a straightforward process requiring only that the sleeve be placed over the neck of the bottle and rotated into position. Next, cork 12 is installed in a conventional manner by compression and axial insertion into the mouth of the bottle. After cork 12 is inserted, anchor 10 is installed by centering it in cork 12 and rotating it into position while applying axial pressure. Finally, reseal cap 16 is screwed onto nipple portion 32 of cork-pulling sleeve 14.

Removal of the cork follows a similar process in reverse order, except that the anchor is not removed. To remove the cork, the consumer merely twists cork-pulling sleeve 14 in relation to bottle 22. Due to the mating of threads 18 on cork-pulling sleeve 14 and threads 20 on bottle 22, cork-pulling sleeve 14 moves axially when rotated. This causes lip 40 of nipple portion 32 of cork-pulling sleeve 14 to apply axial pressure to the underside of head 42 of anchor 10, which results in cork 12 being removed from bottle 22. After cork 12 is removed along with cork-pulling sleeve 14, reseal cap 16 can be screwed onto bottle 22 for sealing the bottle to preserve the wine until the bottle is emptied.

It will be appreciated that a important part of assembly is insertion of anchor 10 into cork 12 because, as stated before, the integrity of cork 12 must not be compromised when an anchor is inserted. The bottom 46 and outside circumference 68 of cork 12 must not be broken through, and little or no tearing or splitting should occur in the interior of cork 12. To maintain the integrity of the cork while insuring that anchor 10 is sufficiently secured in cork 12 to withstand a pulling force of approximately 40 kg, the overall diameter of shank 54 and threads 60 preferably should not exceed approximately 9.0 mm. The diameter of shank 54 preferably should be approximately 3.0 mm to 4.0 mm and the protrusion of threads 60 from shank 54 preferably should not exceed approximately 2.0 mm to 2.5 mm on each side of the shank. Furthermore, to prevent or minimize cork tearing between the threads when anchor 10 is pulled on, preferably there should be approximately 8.0 mm of separation between threads. Also, distal end 56 of anchor 10 preferably should not be closer than approximately 10 mm to bottom 46 of cork 12. In this manner, anchor 10 is specially designed so that it can be screwed into cork 12 without tearing or splitting the cork. It will be appreciated that the exact dimensions to be used can be adjusted to accommodate the desired range of natural cork grades and desired variety of agglomerated and synthetic cork types. Note also that a pilot hole for the anchor is not required, but one can optionally be used. For example, for the anchor shaft and thread dimensions described above, a pilot hole of approximately 2 mm in diameter can be drilled at, or near, the center of cork 12 and down the longitudinal axis to approximately 10 mm from the bottom 46 of cork 12 if desired to facilitate installation of the anchor. To further ease installation of the anchor, the bottler or manufacturer may additionally choose to coat either the anchor or the optional pilot hole with one or more lubricants or materials to reduce cork tearing upon anchor insertion or to enhance security of the anchor to cork connection.

Thus far, anchor head 42 has been shown as simply having a flat, smooth face. This then begs the question of how to twist anchor 10 into the cork 12 while applying axial pressure. Referring now to FIG. 7 through FIG. 13, various embodiments of anchor head configurations that address this issue are shown.

As described above, neck 62 on anchor 10 provides a means for ensuring aligning of anchor head 42 with the lip 40 on cork-pulling sleeve 14. While the height of neck 62 preferably should be minimized as much as possible so that the outward appearance of the cork-pulling sleeve/reseal cap combination emulates that of a traditional foil capsule as much as possible, the added overall height as compared to an anchor head 10 without a neck 62 facilitates the inclusion of means to accurately grasp and hold the anchor head during insertion into cork stopper 12.

It will be appreciated that in a high output bottling facility it is desirable to seal bottles at a high speed. Therefore, it would be desirable to be able to mechanically insert anchors into the cork stoppers at a high speed. The key to any successful high-speed anchor inserting machine would be the machines' ability to consistently transfer individual anchors to a "chuck" or holder/driver that inserts them into the individual stopper. Such a machine preferably should be a continuous motion type; that is, it would move at a relatively constant speed and not have a stop or dwell point timed with each insertion operation. When viewed from above, the drive chuck would typically travel in a circle. (For the sake of this description imagine the circle to have about a 2-ft radius.) At the same time the chuck is moving about the above-described circle, it is rotating on its own axis, which is parallel to the axis of the larger circle. This motion is similar to the motion of the earth traveling about the sun. Simultaneously with the movement of the chuck, the mass of anchors would be oriented and funneled into a track in single file and eventually fed one by one into a device that carries them through a different circular path that ends up tangent to the circular path of the chuck. (Imagine this circular path to have a radius of about 10 inches) It is at that "moment" where the anchor and chuck paths are tangent or aligned that the anchor would be transferred to the chuck.

The transfer point is actually a very narrow "window". The transfer is complicated by the need to almost instantaneously align the mating features (e.g., splines) in the anchor and the chuck that allow the two to become locked so the anchor can be screwed onto the stopper. For the transfer to work effectively every time, the number of splines must be great enough so that a relatively small amount of rotation of chuck to anchor will allow alignment and lock-up of the two parts while in the "window". The number of splines needed on any such machine is driven primarily by the amount of chuck rotation that takes place in the "window" and is in all cases greater than the standard six flats (or splines as is the case with the torx style socket screws) used on commercial fasteners. In fact, it is likely that the number of splines needed will always be greater than forty.

While the use of splines as complementary mating features is not a new concept, it is believed that spline-like features should be used on an anchor that will successfully work in a high speed insertion machine. Furthermore, referring to FIG. 7 through FIG. 13, the spline-like features depicted in those drawings are quite different from commonly used splines that are on the outer circumference of the structure (i.e., external splines). Because of the relatively limited surface area of the large diameter of anchor head 42 and the desire to minimize the amount of material used in the manufacture of anchor 10, it is desirable to use internal splines.

Figure 7:
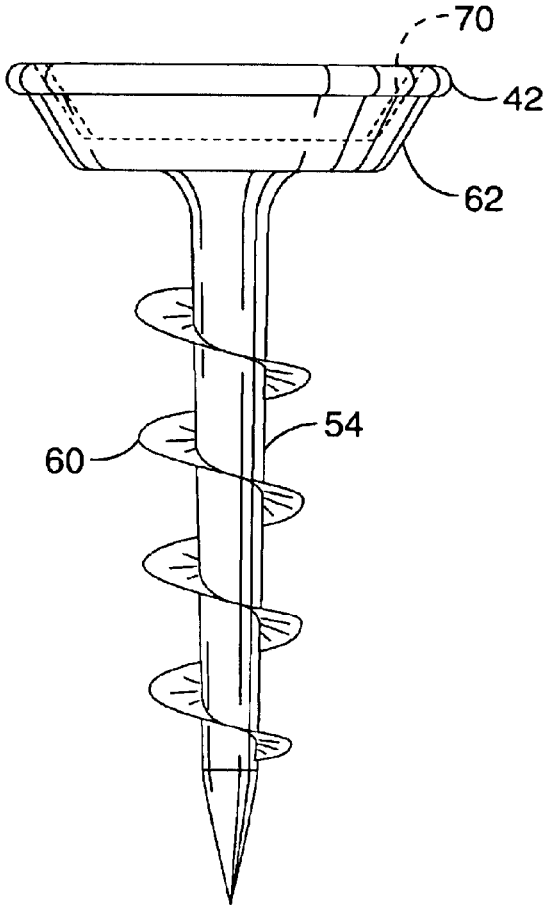
FIG. 7 is a side view of an anchor according to the invention with conical splines in the head and neck of the anchor.
Figure 8:
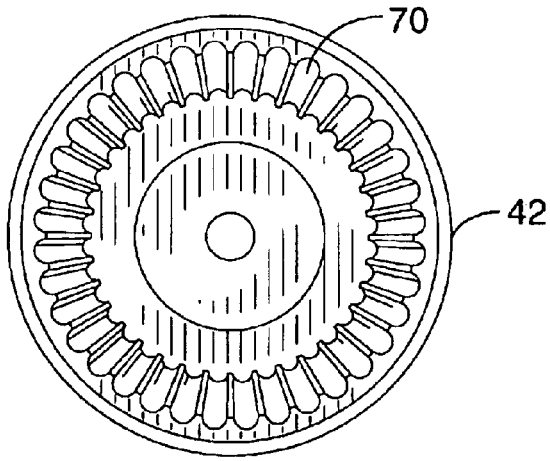
FIG. 8 is a top view of the head of the anchor shown in FIG. 7.
Figure 9:
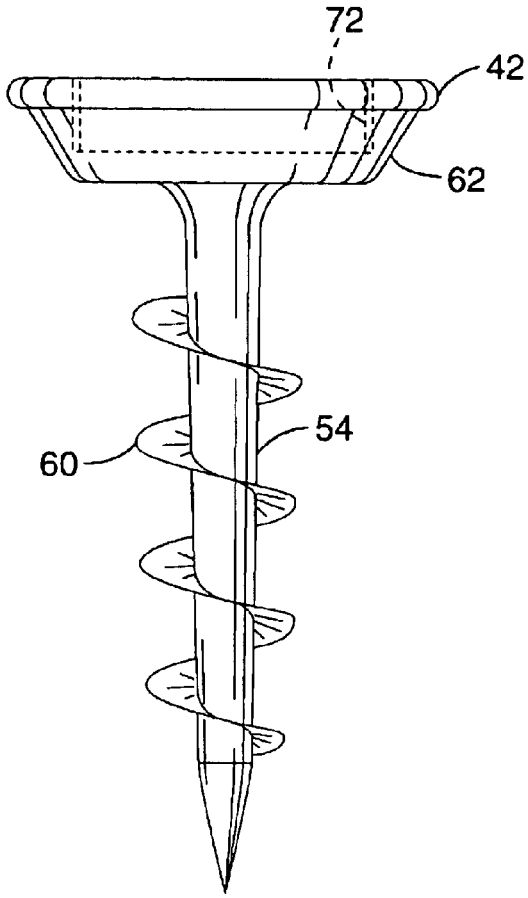
FIG. 9 is a side view of an anchor according to the invention with cylindrical splines in the head and neck of the anchor.
Figure 10:
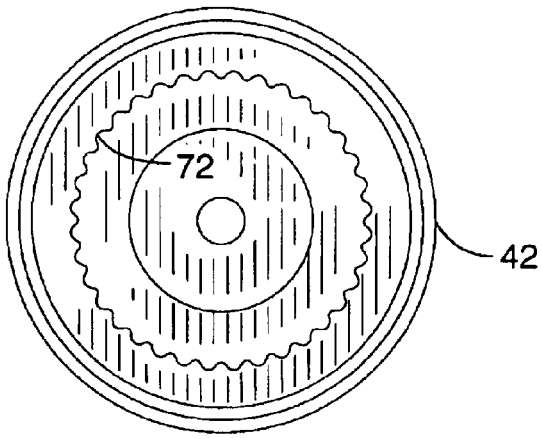
FIG. 10 is a top view of the head of the anchor shown in FIG. 9.
Figure 11:
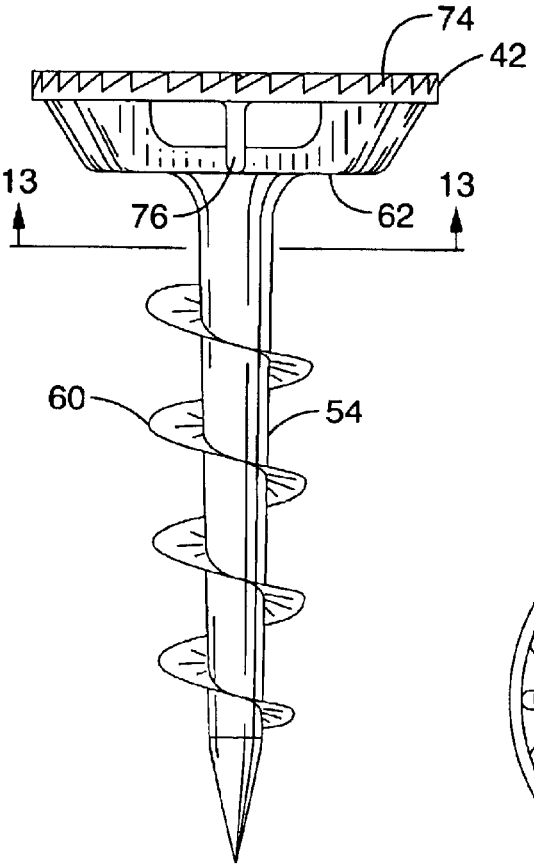
FIG. 11 is a side view of an anchor according to the invention with splines on the face of the head of the anchor and a ribbed neck.
Figure 13:
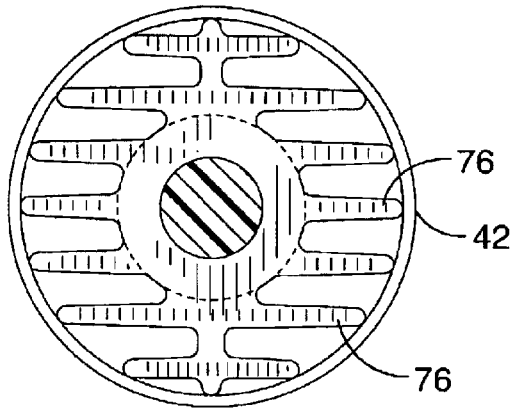
FIG. 13 is a cross-section view of the anchor shown in FIG. 11 taken through lines 13—13.
Figure 12:
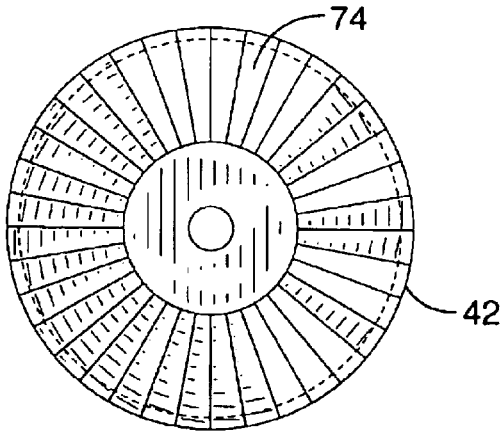
FIG. 12 is a top view of the head of the anchor shown in FIG. 11.

There are many ways drive splines can be internally formed in anchor head 42. For example, drive splines 70 having a conical profile as shown in FIG. 7 and FIG. 8 may be employed. Alternatively, drive splines 72 having a cylindrical profile as shown in FIG. 9 and FIG. 10 could be employed. The form may even be curved or parabolic, or any other suitable form. Another alternative is to form splines 74 on the top of anchor head 42 as shown in FIG. 11 and FIG. 12. Note from FIG. 11 that the splines are configured so that they would drive a right hand threaded anchor yet, show the threads on the anchor are left-handed. Note also that placement of splines 74 on top of anchor head 42 does not require the added height provided by neck 62, although neck 62 is still desirable for alignment purposes. However, since the large volume of neck 62 would not be required for the splines, portions of neck 62 could be removed to create the ribbed form shown in FIG. 13. Here, a plurality of ribs 76 would provide the structural support and strength for anchor head 42 while still functioning as an alignment feature. With any form of splines used, it will be appreciated that the form of the splines in the anchor 10 will dictate the complementary form of external splines on the chuck.

Figure 14:
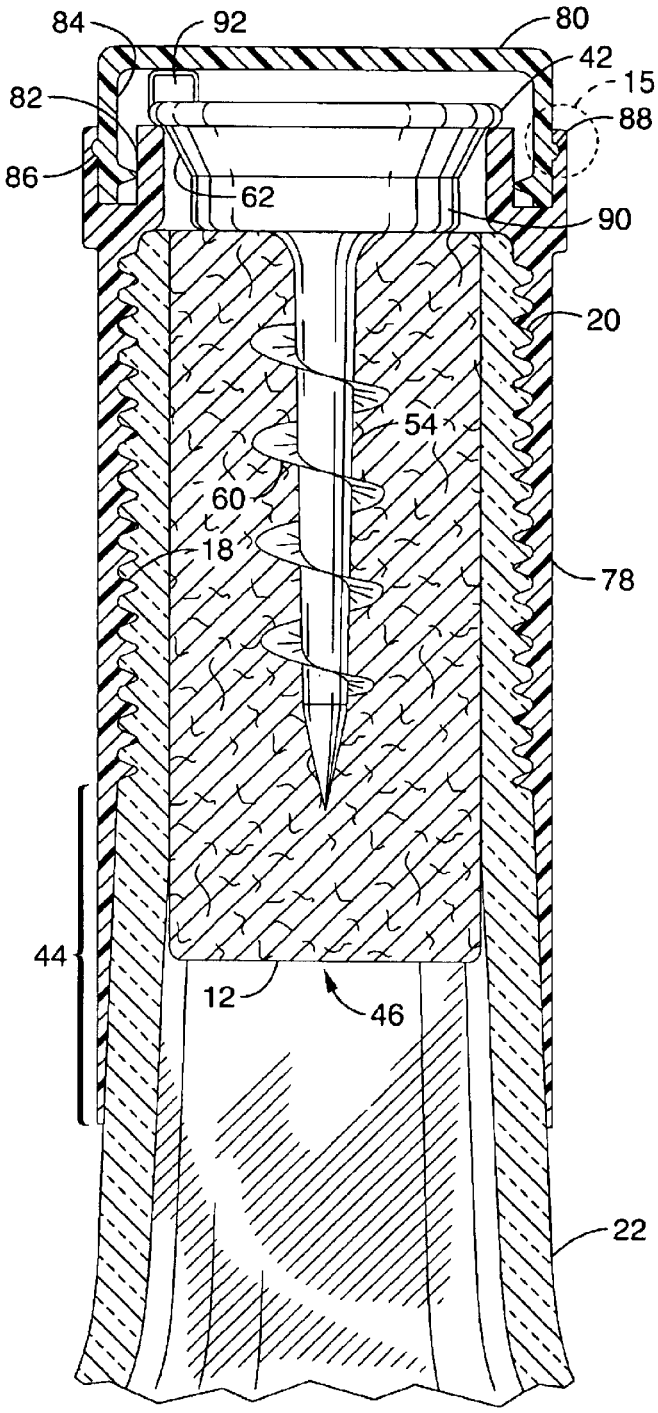
FIG. 14 is a side cross-sectional view of an alternative embodiment of the cork removal apparatus shown in FIG. 1 where the reseal cap snaps onto the cork-pulling sleeve, the neck portion of the anchor is extended, and the anchor head includes a reseal cap removing protrusion, shown with the anchor inserted in the cork, the cork inserted in the bottle, the cork-pulling sleeve screwed onto the bottle, and the reseal cap snapped onto the on the cork-pulling sleeve.
Figure 15:
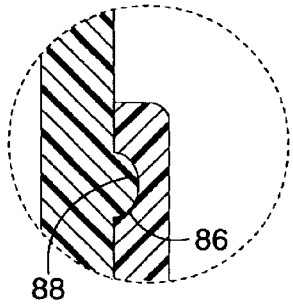
FIG. 15 is a detail view of the bead and groove snap mechanism for coupling the reseal cap and cork-pulling sleeve of FIG. 14.

Referring now to FIG. 14 and FIG. 15, an alternative embodiment of a cork-pulling sleeve 78 is shown configured to receive a reseal cap 80 that snaps onto the cork-pulling sleeve 78 but screws onto the bottle 22. In this embodiment, instead of a threaded nipple portion as previously shown, the cork-pulling sleeve 78 includes an annular receptacle 82 configured to receive the threaded sidewall 84 of reseal cap 80. In addition, the annular receptacle includes an annular groove 86 configured to receive an annular bead 88 on the outer surface of reseal cap 80. Note that reseal cap 80 is the same as reseal cap 16 described previously except for the outer annular snap bead 88. Those skilled in the art will appreciate that other snap-type mating features can be used as well. Note also the optional neck extension 90 that rests against the top of the cork 12 for positioning the height of the anchor head 42.

While it may not be readily apparent, a reseal cap that snaps onto the cork-pulling sleeve has several advantages over a reseal cap that screws onto the cork-pulling sleeve; namely, the reseal cap can be made difficult or impossible to remove before the bottle is opened through limited exposure of the top of the cap (i.e., minimal sidewall surfaces to grasp) and a highly resistive snap on feature. At the same time, however, the reseal cap should also be easy to detach from the cork-pulling sleeve after the bottle has been opened.

Limited exposure of the top of the reseal cap means that, once the bottle is opened, the consumer will need to push on the far end 46 ("wet" end) of cork 12 to force reseal cap 80 off the end of the cork-pulling sleeve. To make it easier to overcome the force needed to pop the reseal cap off of the cork-pulling sleeve regardless of the particular snap-type mating feature used, a small bump or high spot 92 is placed on the top of anchor head 42. Bump 92 directs the force applied by the consumer to a local spot somewhere near the outer diameter of reseal cap 80 which creates a definite beginning place to the unseating of bead 88 and groove 86 that help retain reseal cap 80. This application of opening force in an off center manner reduces the total opening force required of the consumer to break the cap free of cork-pulling sleeve 14 so it may be used separately and so cork 12 may be accessed for inspection. Although not shown, it will be appreciated that a snap-on type reseal cap and cap removal means as described can be used in combination with any of the drive spline configurations and anchor head configurations previously described.

While it is possible to combine the reseal cap with the rest of the package in other positions (such as in the punt cavity of the bottle), attaching the reseal cap to the top of the cork-pulling sleeve is advantageous when considering the need to integrate this technology on a bottling line. The reseal cap also plays a part in the way the consumer would be warned if the package were tampered with. For example, consider the situation where a bottle is partially opened by rotating the cork-pulling sleeve. If the cork-pulling sleeve opening direction is reversed back toward its original position, it will pop off any of the reseal caps previously described. Even if someone is strong enough to push on the head of the anchor with sufficient force to move the cork stopper back into the bottle, there is sufficient spring in the mode of attachment between the cork stopper and anchor that the anchor head will not completely seat against the cork-pulling sleeve. This prevents the reseal cap from being snapped or screwed back into position and makes it evident someone has tried to open the bottle.

Figure 16:
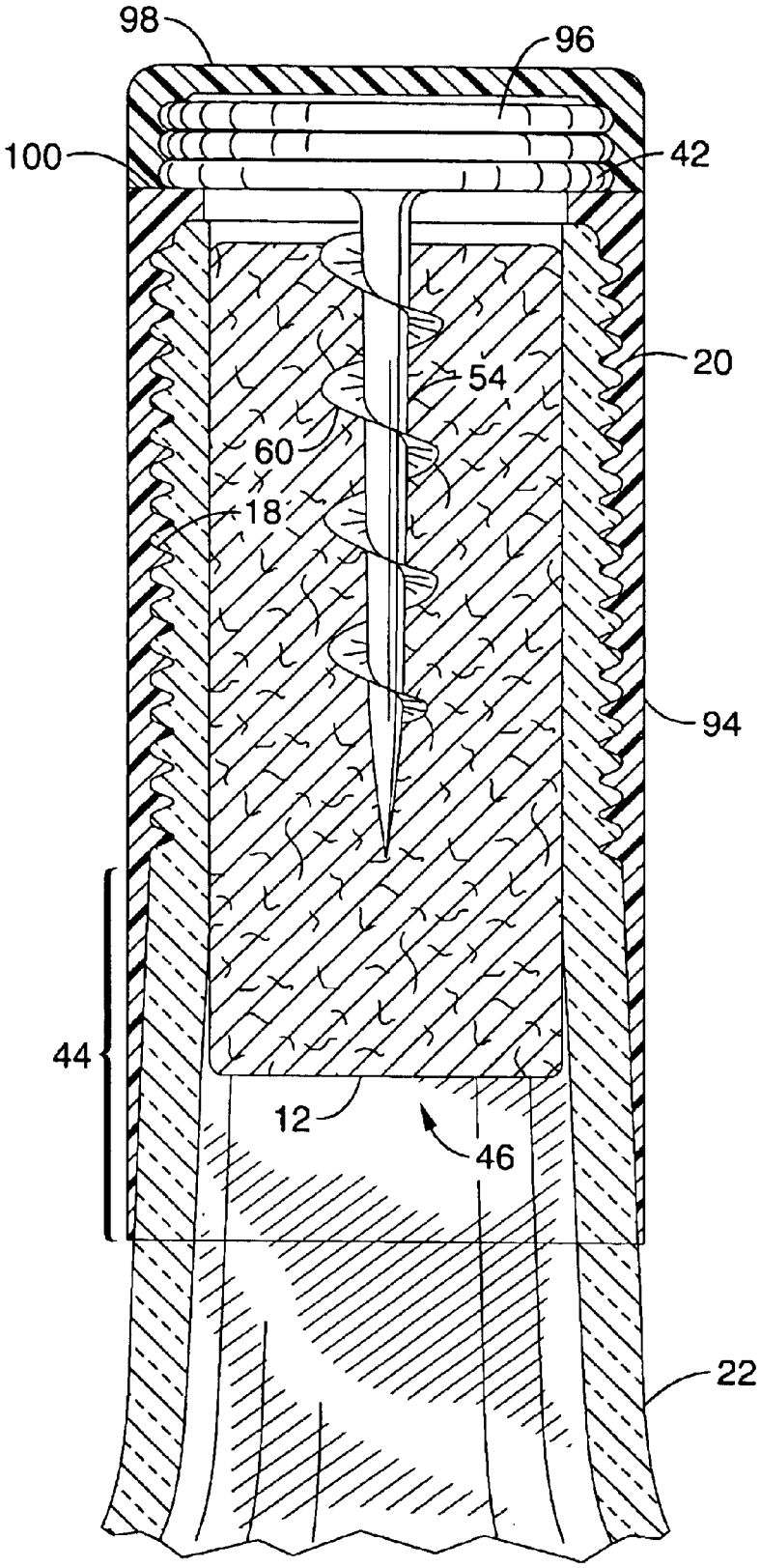
FIG. 16 is a side cross-sectional view of an alternative embodiment of the cork removal apparatus shown in FIG. 1 where the reseal cap snaps onto the head of the anchor and the anchor does not include a neck portion, shown with the anchor inserted in the cork, the cork inserted in the bottle, the cork-pulling sleeve screwed onto the bottle, and the reseal cap snapped onto the head of the anchor.
Figure 17:
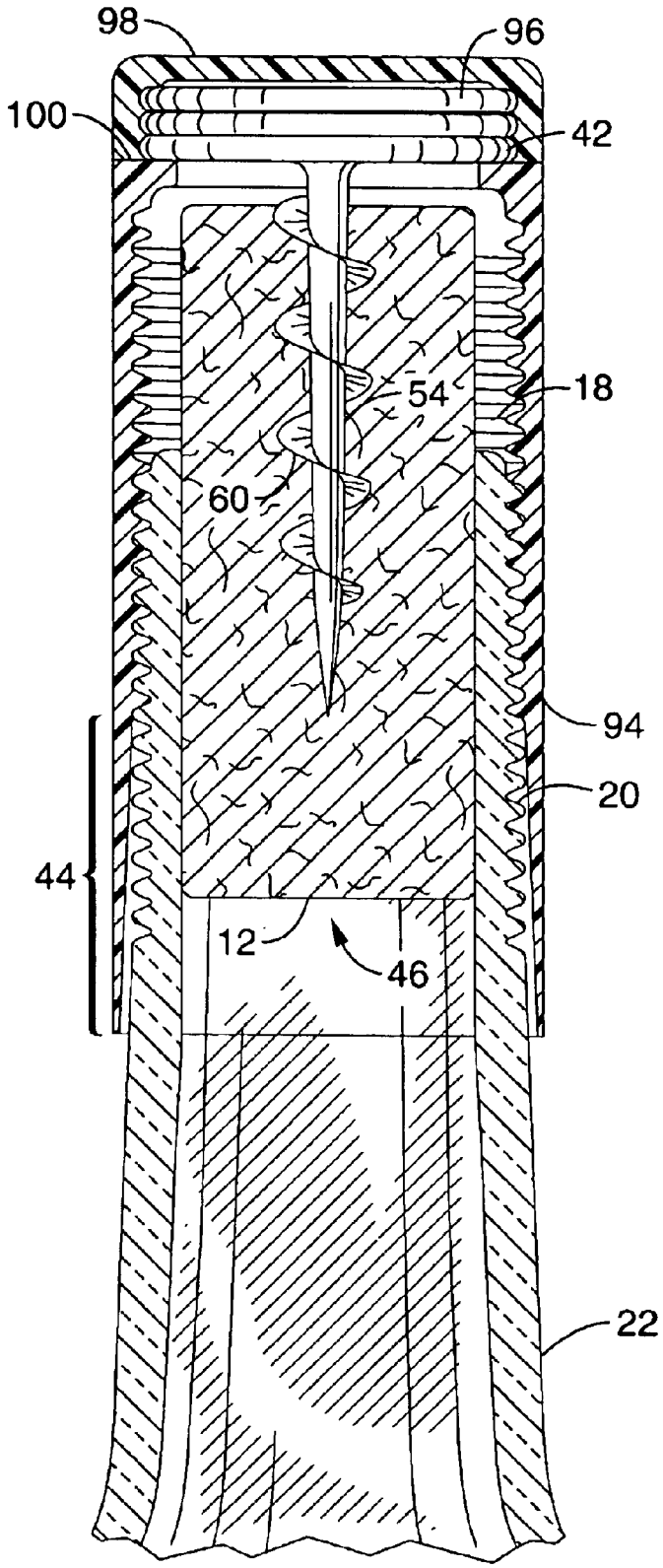
FIG. 17 shows the assembly of FIG. 16 with the cork-pulling sleeve and cork partially removed.

Still further embodiments of the cork-pulling sleeve, reseal cap, and anchor are shown in FIG. 16 which shows the cork-pulling sleeve fully seated and FIG. 17 which shows the cork-pulling sleeve partially removed. Here, the tapered neck beneath the anchor head of the previously described anchor has been eliminated so that the top of the anchor has a flat profile. Note also that the optional collars on the reseal cap and end of the cork-pulling sleeve shown in previously described embodiments have been removed as well. Furthermore, the cork-pulling sleeve in this embodiment does not include a nipple or groove that mates with the reseal cap. In the embodiment shown in FIG. 16 and FIG. 17, the threads 96 of reseal cap 98 simply snap onto anchor head 42. Cork-pulling sleeve 94 includes an annular lip 100 that engages the underside of anchor head 42 in the manner previously described for extraction of cork 12 by rotation of the cork-pulling sleeve 94. Once cork 12 is extracted, reseal cap 98 can be screwed onto bottle 22.

Figure 18:
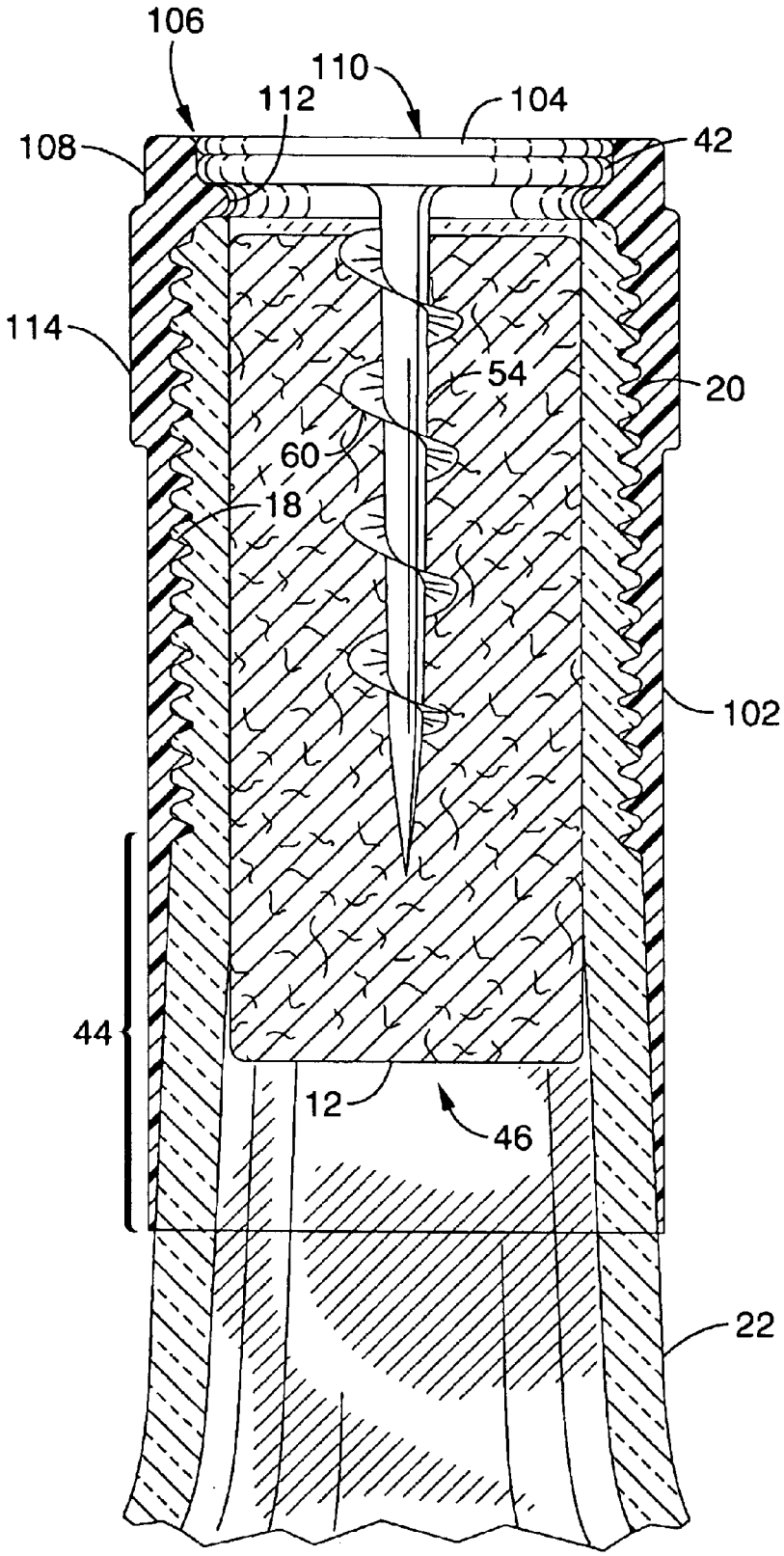
FIG. 18 is side cross-sectional view of an alternative embodiment of the cork removal apparatus shown in FIG. 1 where a reseal disk is used instead of a reseal cap, shown with the anchor inserted in the cork, the cork inserted in the bottle, the cork-pulling sleeve screwed onto the bottle, and the reseal disk press-fitted into the cork-pulling sleeve above the anchor head.
Figure 19:
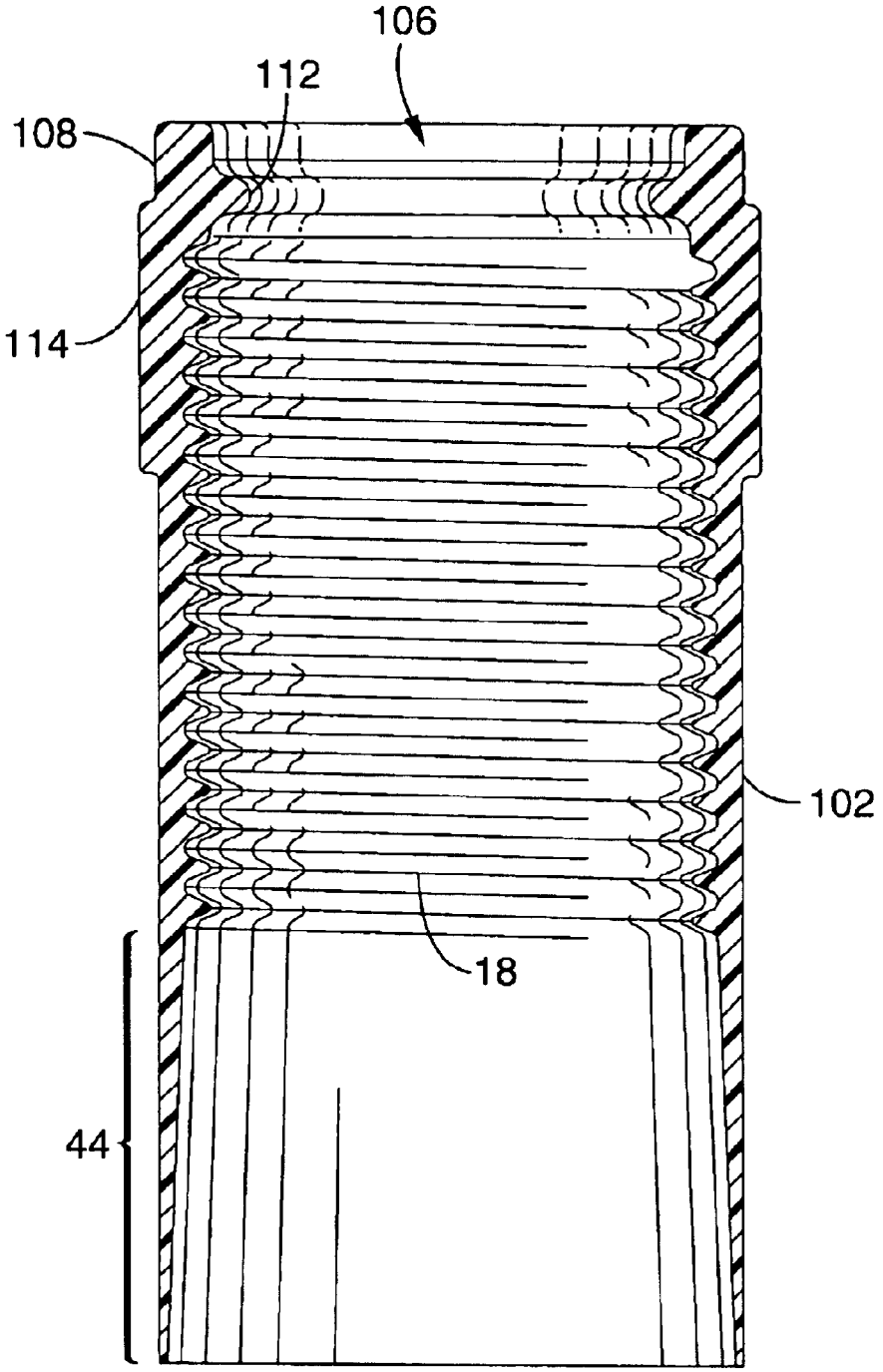
FIG. 19 is a side cross-sectional view of the cork-pulling sleeve shown in FIG. 18.

Referring now to FIG. 18 through FIG. 22, another embodiment of the invention is shown which again uses the "flat top" anchor configuration of FIG. 16 and FIG. 17. As can be seen in FIG. 18 and FIG. 19 particularly, the cork-pulling sleeve 102 of this embodiment is configured to receive a reseal disk 104 that is press-fit into an opening 106 in the end of cork-pulling sleeve 102. It will be appreciated that opening 106 would have a sufficiently smaller diameter than the diameter of reseal disk 104 to accommodate a press-fit engagement as shown. Alternatively, an annular groove (not shown) could be provided in the end of cork-pulling sleeve 102 to receive reseal disk 104. The sidewalls 108 defining opening 106 in cork-pulling sleeve 102 are sized to that the face 110 of reseal disk 104 is flush with the end of the of cork-pulling sleeve 102 as shown. An annular rib 112 is also provided for engagement of the cork-pulling sleeve 102 with the underside of anchor head 42. In addition, an optional collar 114 can be included on cork-pulling sleeve 102 to simulate the appearance of the end of a conventional wine bottle.

Figure 20:
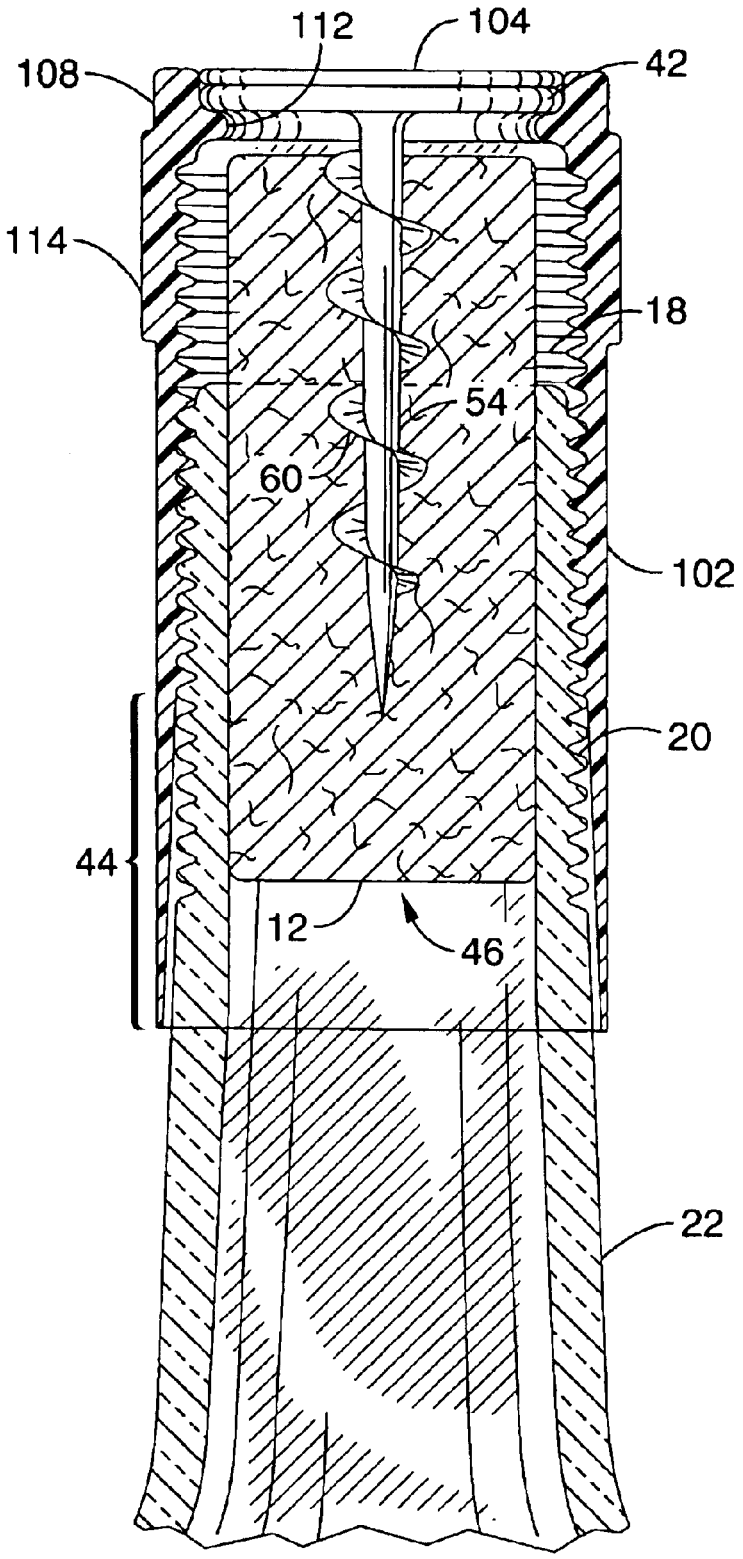
FIG. 20 shows the assembly of FIG. 17 with the cork-pulling sleeve and cork partially removed.
Figure 21:
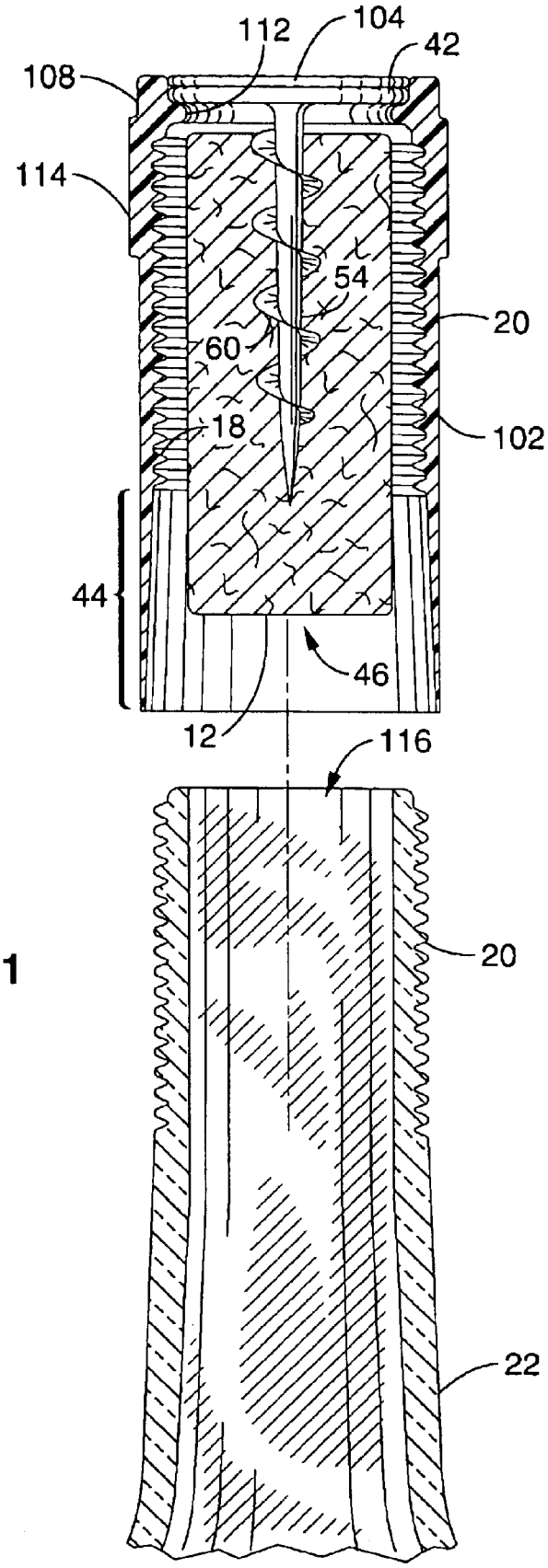
FIG. 21 is an exploded view of the cork removal apparatus shown in FIG. 18 after complete removal of the cork-pulling sleeve and cork from the bottle.
Figure 22:
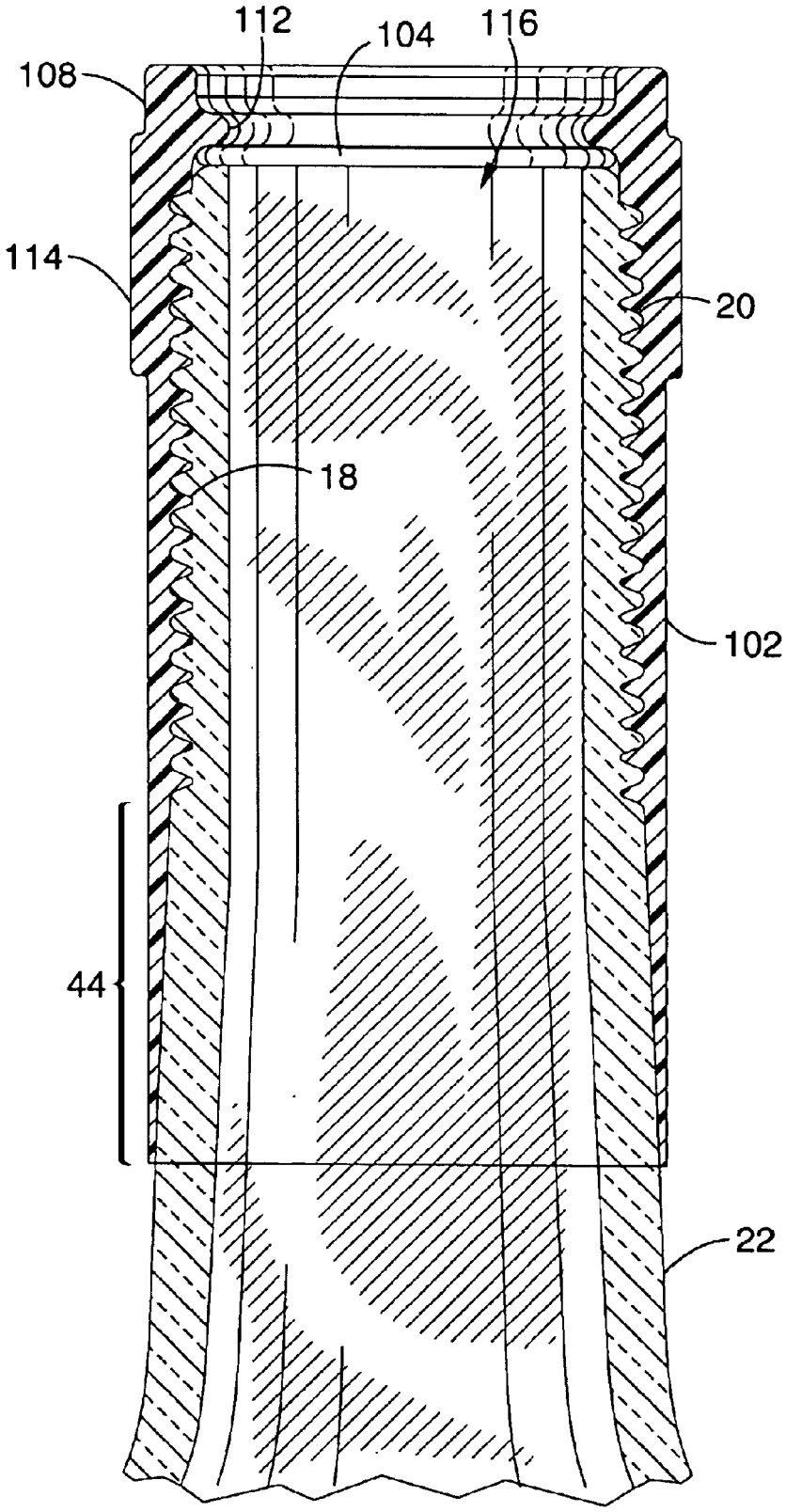
FIG. 22 is a side cross-sectional view of the cork removal apparatus shown in FIG. 18 with the reseal disk placed in position for sealing the bottle after the cork has been removed and the cork-pulling sleeve reinstalled on the bottle to hold the reseal disk in place.

Removal of cork 12 progresses from a fully seated position as shown in FIG. 18 to a partially extracted position as shown in FIG. 20 to a fully extracted position as shown in FIG. 21. Referring to FIG. 21 and FIG. 22, to reseal bottle 22 in this embodiment, reseal disk 104, which abuts anchor head 42, is removed from the upper end of cork-pulling sleeve 102 by the consumer pushing on the far end ("wet" end) of the cork to force reseal disk 104 out of the end of cork-pulling sleeve 102. Then, as shown in FIG. 22, reseal disk 104, which has a diameter larger than the diameter of the mouth 116 of the bottle 22, is placed over the end of the bottle 22. Cork-pulling sleeve 102 is then screwed onto bottle 22 wherein annular rib 112 compresses reseal disk 104 against the end of bottle 22. Reseal disk 104 is thereby held fast against the end of bottle 22 in much the same way a flat lid is held onto the open end of a mason jar.

Figure 23:
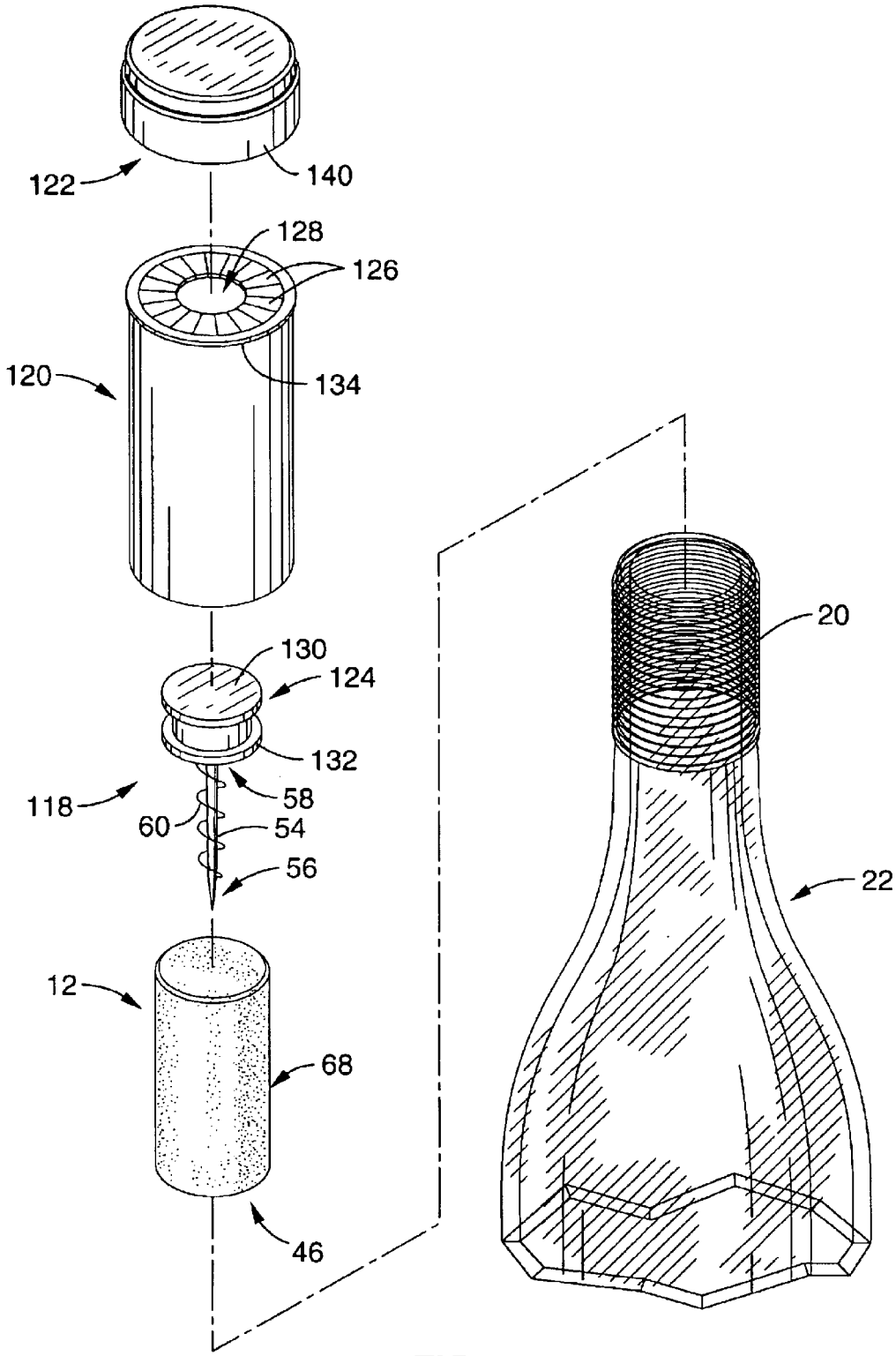
FIG. 23 is an exploded view of an alternative embodiment of the cork removal apparatus shown in FIG. 1 wherein the anchor has a bobbin-shaped head and the cork-pulling sleeve includes resilient fingers for engaging the anchor head, shown in context with a conventional cork and a bottle modified to include outer threads on the neck of the bottle.
Figure 24:
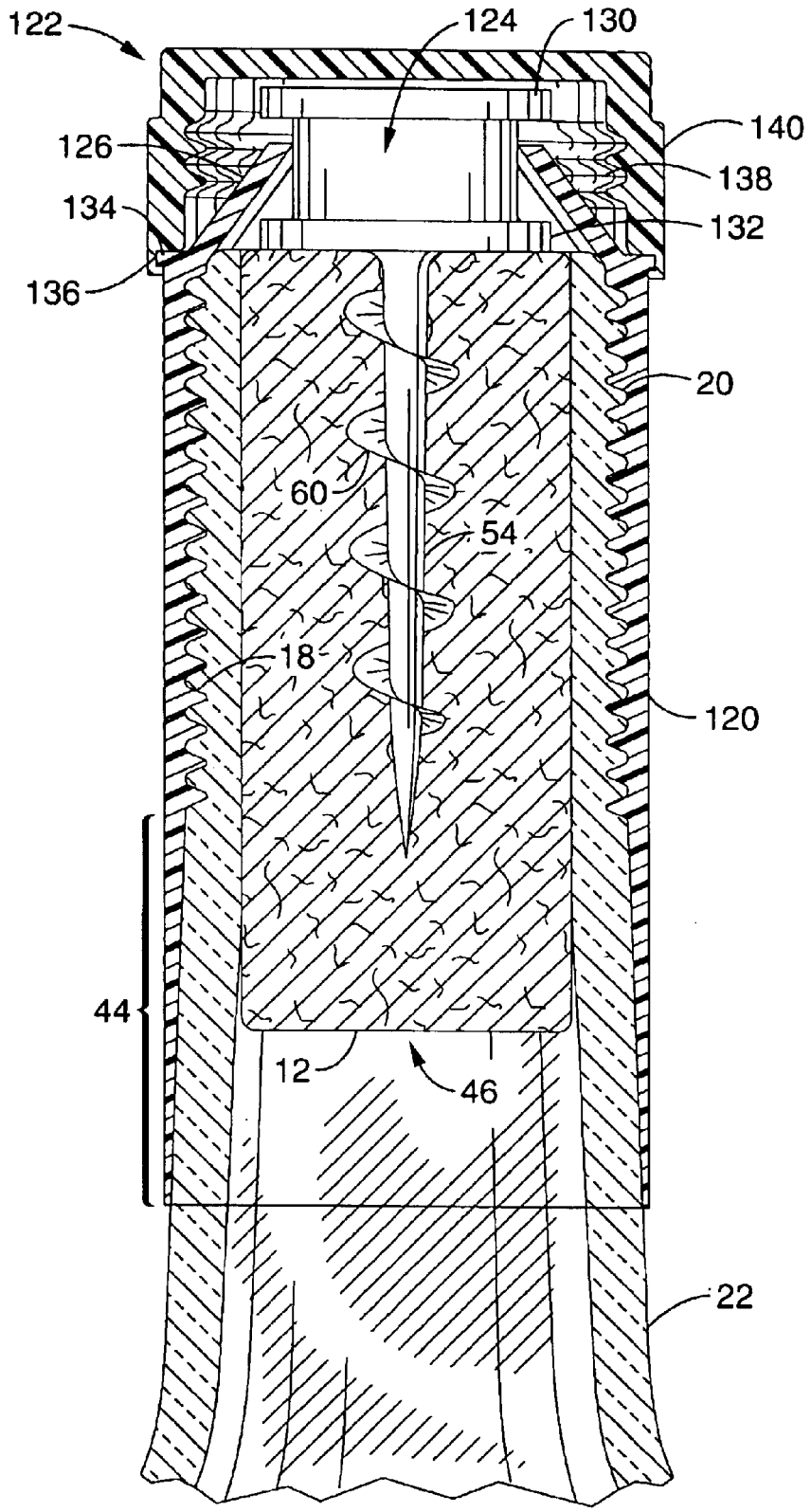
FIG. 24 is a side cross-sectional view of the cork removal apparatus shown in FIG. 23 with the anchor inserted in the cork, the cork inserted in the bottle, the cork-pulling sleeve screwed onto the bottle, and the reseal cap screwed onto the on the cork-pulling sleeve.
Figure 25:
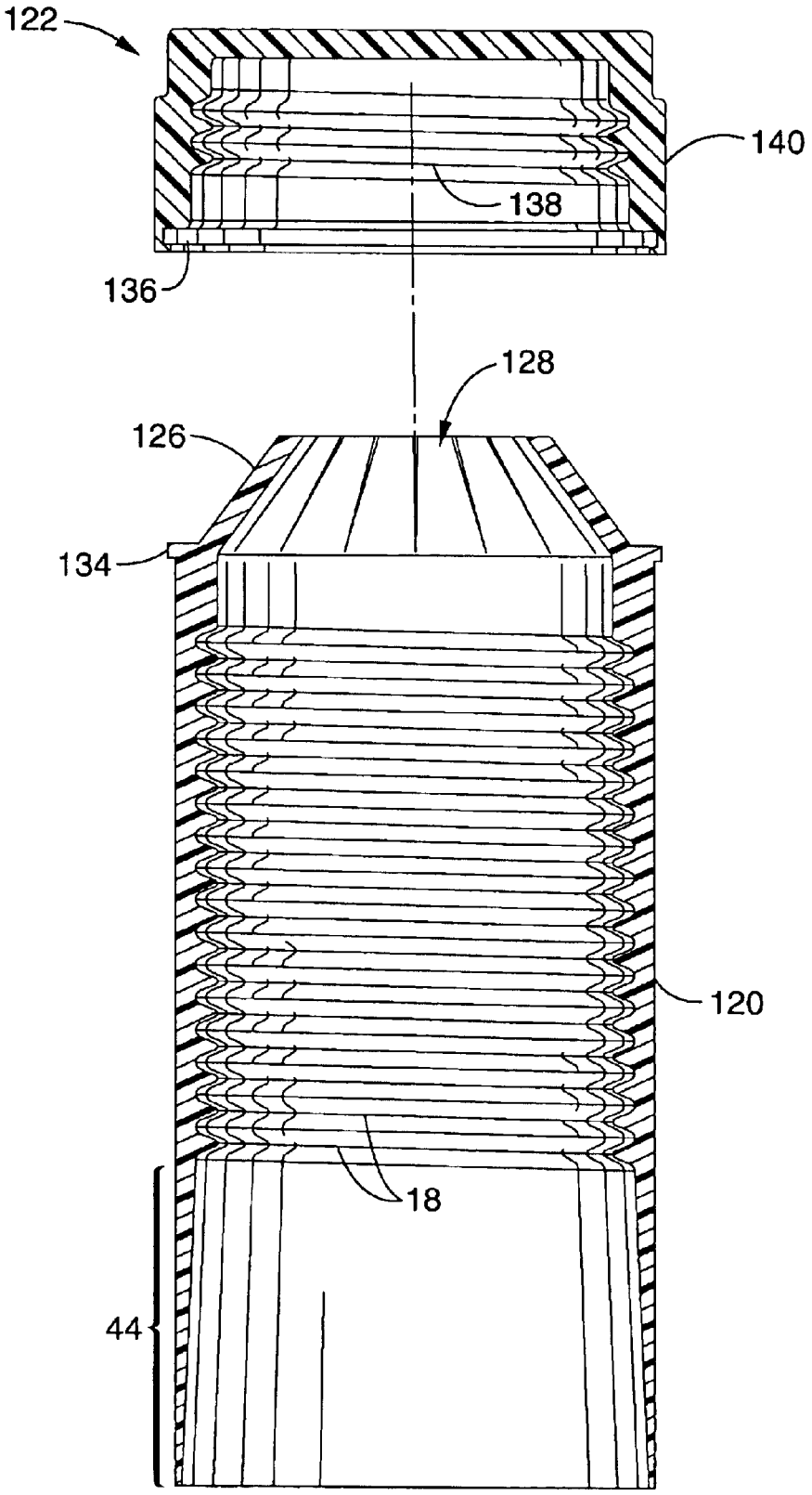
FIG. 25 is an exploded side cross-sectional view of the cork-pulling sleeve and reseal cap portions of the cork removal apparatus shown in FIG. 23.

A still further embodiment of the invention is shown in FIG. 23 through FIG. 25. In this embodiment, however, assembly of the anchor, cork, and cork-pulling sleeve follows a different sequence than described previously. Assembly is carried out by first inserting anchor 118 in cork 12. Next, the combination anchor 118 and cork 12 is installed in a conventional manner by compression and axial insertion into the mouth of the bottle. After the combination of anchor 118 and cork 12 is inserted, cork-pulling sleeve 120 is installed on bottle 22. As before, this is a straightforward process requiring only that the sleeve be placed over the anchor and neck of the bottle and rotated into position. Finally, reseal cap 122 can be installed.

The order of assembly thus described for this embodiment of the invention is dictated by the configuration of anchor 118 and cork-pulling sleeve 120 employed. In this embodiment, anchor 118 includes a "bobbin" shaped head 124 and cork-pulling sleeve 120 includes a plurality of resilient "fingers" 126. As can be seen in FIG. 24, when cork-pulling sleeve 120 is placed over anchor head 124 and screwed onto bottle 22, fingers 126 deflect to allow the larger anchor head 124 to pass through the smaller opening 128 defined by fingers 126. When cork-pulling sleeve 120 is in its fully seated position, the ends of fingers 126 rest between an upper 130 and lower 132 disk on anchor head 124. During removal of cork-pulling sleeve 120, fingers 126 engage the underside of upper disk 130 and apply axial pressure to anchor head 124 and cork 12 is extracted.

In this embodiment, fingers 126 are the most heavily stressed part of the structure. The more closely their orientation can be maintained parallel to the direction of travel of cork stopper 12 the less the force will be transmitted through them to achieve a given opening force. In order to keep fingers 126 as close to the travel direction of cork stopper 12 as possible, the diameter of anchor head 124 should be kept as large as possible and the diameter of the finger attachment to the cork-pulling sleeve should be kept as small as possible.

Note that the desire to keep anchor head 124 as large as possible has to be balanced with the need to make anchor head 124 small enough so it will pass through the die in a conventional corking machine. Most corking machines reduce the diameter of the cork into a range of 15 millimeters to 17 millimeters. This limits the maximum diameter for the anchor head. Note also that anchor head 124 must be capable of surviving the plunger force required to push the squeezed down cork out of the die and into the bottle, which force can reach as high as 1200 lbs. The issue is not the ability of anchor head 124 to withstand the push, but to ensure that the force is transmitted through anchor head 124 to the upper end of cork stopper 12, and not into cork stopper 12 through threads 60 of anchor 118 which could promote leaking. From the test insertions completed to date with a hand corker, it appears the diameter of the surface of lower disk 132 which is in contact with the top of cork stopper 12 should be at least 9.9 mm.

It will be appreciated that there is an available range in the anchor head size needed to meet the above requirements. The aspect of the insertion process that is not readily apparent is the fact that the dies used to reduce the diameter of the cork stopper prior to inserting into the bottle are only long enough for the cork stopper itself. This means that alignment of anchor head 124 with the opening in the dies must be maintained closely.

As with the embodiments of the invention previously described, various drive spline configurations and anchor securing configurations can be employed. In addition, various reseal cap configurations can be employed. In the embodiment shown, reseal cap 122 snaps onto cork-pulling sleeve 120 by means of an annular collar 134 on the end of cork-pulling sleeve 120 and corresponding annular groove 136 inside reseal cap 122. In addition, reseal cap 122 includes inner threads 138 which mate with threads 20 on bottle 22. Reseal cap can also include an optional collar 140 to simulate the appearance of the end of a conventional wine bottle.

Accordingly, it will be seen that this invention provides various embodiments of an integrated cork stopper/anchor assembly for a wine bottle, or the like, that can be removed using a cork-pulling sleeve capable that is packaged with the bottle and which replaces the traditional foil capsule. The anchor can be installed in any type of cork including natural corks, agglomerated natural cork, synthetic corks, and others including plastic corks and the like. In all embodiments of the invention, the anchor can be constructed from metal, or preferably from a medium-hard polyester resin, such as polyethylene or similar material that can be used in an injection mold. The cork-pulling sleeve and reseal caps and disks are preferably made from an injection moldable plastic material or the like. Furthermore, those skilled in the art will appreciate that the structural and functional features of the various reseal caps, anchors, and cork-pulling sleeves can be substituted among the various embodiments of the invention described. It will also be appreciated that the reseal cap or disk, as well as the cork-pulling sleeve can carry logos, artistic designs, labeling information and the like, and that the threads on the bottle can be of a conventional configuration as shown as well be formed to display a logo or artistic design.

Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims and their legal equivalents, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for removing a cork stopper from a bottle, comprising:

(a) an anchor, said anchor including a head portion, said anchor including a shank portion configured for being secured in a cork stopper; and (b) a sleeve, said sleeve including inner threads configured for engaging outer threads on a borne, said sleeve configured for engaging said head of said anchor and applying force required for removal of said cork stopper when said sleeve is unscrewed from said bottle;

(c) wherein said sleeve includes a threaded nipple portion configured to receive a threaded reseal cap.

2. An apparatus for removing a cork stopper from a bottle, comprising:

(a) an anchor, said anchor including a head portion, said anchor including a shank portion configured for being secured in a cork stopper; and (b) a sleeve, said sleeve including inner threads configured for engaging outer threads on a bottle, said sleeve configured for engaging said head of said anchor and applying force required for removal of said cork stopper when said sleeve is unscrewed from said bottle;

wherein said sleeve includes a grooved receptacle configured to receive a reseal cap.

3. An apparatus for removing a cork stopper from a bottle, comprising:

(a) an anchor, said anchor including a head portion, said anchor including a shank portion configured for being secured in a cork stopper; and (b) a sleeve, said sleeve including inner threads configured for engaging outer threads on a bottle, said sleeve configured for engaging said head of said anchor and applying force required for removal of said cork stopper when said sleeve is unscrewed from said bottle;

(c) wherein said sleeve is configured to receive a reseal disk.

4. An apparatus for removing a cork stopper from a bottle, comprising:

(a) an anchor, said anchor including a head portion, said anchor including a shank portion configured for being secured in a cork stopper; and (b) a sleeve, said sleeve including inner threads configured for engaging outer threads on a bottle, said sleeve configured for engaging said head of said anchor and applying force required for removal of said cork stopper when said sleeve is unscrewed from said bottle;

(c) wherein said sleeve includes a plurality of resilient fingers configured to engage said head portion of said anchor.

5. An apparatus for removing a cork stopper from a bottle, comprising:

(a) an anchor, said anchor including a head portion, said anchor including a shank portion configured for being secured in a cork stopper;

(b) a sleeve, said sleeve including inner threads configured for engaging outer threads on a bottle, said sleeve configured for engaging said head of said anchor and applying force required for removal of said cork stopper when said sleeve is unscrewed from said bottle; and (c) a reseal cap configured for attachment to said sleeve and further configured for attachment to said bottle.

6. An apparatus as recited in claim 5, wherein said reseal cap is configured to screw onto said sleeve and to screw onto said bottle.

7. An apparatus as recited in claim 5, wherein said reseat cap is configured to snap onto said sleeve and to screw onto said bottle.

8. An apparatus as recited in claim 5, wherein said reseat cap is configured to screw onto said sleeve and to snap onto said bottle.

9. An apparatus as recited in claim 5, wherein said reseat cap is configured to snap onto said sleeve and to snap onto said bottle.

10. An apparatus for removing a cork stopper from a bottle, comprising:

(a) an anchor, said anchor including a head portion, said anchor including a shank portion configured for being secured in a cork stopper;

(b) a sleeve, said sleeve including inner threads configured for engaging outer threads on a bottle, said sleeve configured for engaging said head of said anchor and applying force required for removal of said cork stopper when said sleeve is unscrewed from said bottle; and (c) a reseal cap configured for attachment to said head portion of said anchor and further configured for attachment to said bottle.

11. An apparatus as recited in claim 10, wherein said reseat cap is configured to snap onto said head portion of said anchor and to screw onto said bottle.

12. An apparatus as recited in claim 10, wherein said reseat cap is configured to snap onto said head portion of said anchor and to snap onto said bottle.

13. An apparatus for removing a cork stopper from a bottle, comprising:

(a) an anchor, said anchor including a head portion, said anchor including a shank portion configured for being secured in a cork stopper; and (b) cork removal means for threadably engaging a bottle, for engaging said head portion of said anchor, and for removing said cork stopper from said bottle by rotating said cork removal means in relation to said bottle;

(c) wherein said cork removal means includes a threaded nipple portion configured to receive a threaded reseat cap.

14. An apparatus for removing a cork stopper from a bottle, comprising:

(a) an anchor, said anchor including a head portion, said anchor including a shank portion configured for being secured in a cork stopper; and (b) cork removal means for threadably engaging a bottle, for engaging said head portion of said anchor, and for removing said cork stopper from said bottle by rotating said cork removal means in relation to said bottle;

(c) wherein said cork removal means includes a grooved receptacle configured to receive a reseat cap.

15. An apparatus for removing a cork stopper from a bottle, comprising:

(a) an anchor, said anchor including a head portion, said anchor including a shank portion configured for being secured in a cork stopper; and (b) cork removal means for threadably engaging a bottle, for engaging said head portion of said anchor, and for removing said cork stopper from said bottle by rotating said cork removal means in relation to said bottle;

(c) wherein said cork removal means is configured to receive a reseal disk.

16. An apparatus for removing a cork stopper from a bottle, comprising:

(a) an anchor, said anchor including a head portion, said anchor including a shank portion configured for being secured in a cork stopper; and (b) cork removal means for threadably engaging a bottle, for engaging said head portion of said anchor, and for removing said cork stopper from said bottle by rotating said cork removal means in relation to said bottle;

(c) wherein said cork removal means includes a plurality of resilient fingers configured to engage said head portion of said anchor.

17. An apparatus for removing a cork stopper from a bottle, comprising:

(a) an anchor, said anchor including a head portion, said anchor including a shank portion configured for being secured in a cork stopper;

(b) cork removal means for threadably engaging a bottle, for engaging said head portion of said anchor, and for removing said cork stopper from said bottle by rotating said cork removal means in relation to said bottle; and (c) a reseal cap configured for attachment to said cork removal means and further configured for attachment to said bottle.

18. An apparatus as recited in claim 17, wherein said reseat cap is configured to screw onto said cork removal means and to screw onto said bottle.

19. An apparatus as recited in claim 17, wherein said reseat cap is configured to snap onto said cork removal means and to screw onto said bottle.

20. An apparatus as recited in claim 17, wherein said reseal cap is configured to screw onto said cork removal means and to snap onto said bottle.

21. An apparatus as recited in claim 17, wherein said reseat cap is configured to snap onto said cork removal means and to snap onto said bottle.

22. An apparatus as recited in claim 17, further comprising a reseat cap configured for attachment to said head portion of said anchor and further configured for attachment to said bottle.

23. An apparatus as recited in claim 22, wherein said reseat cap is configured to snap onto said head portion of said anchor and to screw onto said bottle.

24. An apparatus as recited in claim 22, wherein said reseat cap is configured to snap onto said head portion of said anchor and to snap onto said bottle.

25. In a bottle sealed by a cork stopper, an improvement comprising:

(a) an anchor, said anchor including a head portion, said anchor including a shank portion internally secured in said cork stopper; and (b) a sleeve, said sleeve including inner threads engaging outer threads on said bottle, said sleeve configured for engaging said head of said anchor and applying force required for removal of said cork stopper when said sleeve is unscrewed from said bottle;

(c) wherein said sleeve includes a threaded nipple portion configured to receive a threaded reseat cap.

26. In a bottle sealed by a cork stopper, an improvement comprising:

(a) an anchor, said anchor including a head portion, said anchor including a shank portion internally secured in said cork stopper, and (b) a sleeve, said sleeve including inner threads engaging outer threads on said bottle, said sleeve configured for engaging said head of said anchor and applying force required for removal of said cork stopper when said sleeve is unscrewed from said bottle;

(c) wherein said sleeve includes a grooved receptacle configured to receive a reseat cap.

27. In a bottle sealed by a cork stopper, an improvement comprising:

(a) an anchor, said anchor including a head portion, said anchor including a shank portion internally secured in said cork stopper; and (b) a sleeve, said sleeve including inner threads engaging outer threads on said bottle, said sleeve configured for engaging said head of said anchor and applying force required for removal of said cork stopper when said sleeve is unscrewed from said bottle;

(c) wherein said sleeve is configured to receive a reseal disk.

28. An improvement as recited in claim 27, wherein said sleeve includes a plurality of resilient fingers configured to engage said head portion of said anchor.

29. An improvement as recited claim 27, further comprising a reseal cap configured for attachment to said sleeve and further configured for attachment to said bottle.

30. An improvement as recited in claim 29, wherein said reseal cap is configured to screw onto said sleeve and to screw onto said bottle.

31. An improvement as recited in claim 29, wherein said reseal cap is configured to snap onto said sleeve and to screw onto said bottle.

32. An improvement as recited in claim 29, wherein said reseal cap is configured to screw onto said sleeve and to snap onto said bottle.

33. An improvement as recited in claim 29, wherein said reseal cap is configured to snap onto said sleeve and to snap onto said bottle.

34. In a bottle sealed by a cork stopper, an improvement comprising:

(a) an anchor, said anchor including a head portion, said anchor including a shank portion internally secured in said cork stopper;

(b) a sleeve, said sleeve including inner threads engaging outer threads on said bottle, said sleeve configured for engaging said head of said anchor and applying force required for removal of said cork stopper when said sleeve is unscrewed from said bottle; and (c) a reseal cap configured for attachment to said head portion of said anchor and further configured for attachment to said bottle.

35. An improvement as recited in claim 34, wherein said reseal cap is configured to snap onto said head portion of said anchor and to screw onto said bottle.

36. An improvement as recited in claim 34, wherein said reseal cap is configured to snap onto said head portion of said anchor and to snap onto said bottle.

* * * * *